US007931542B2

(12) United States Patent
Kusumoto

(10) Patent No.: US 7,931,542 B2
(45) Date of Patent: Apr. 26, 2011

(54) GOLF CLUB

(75) Inventor: Harunobu Kusumoto, Higashikurume (JP)

(73) Assignee: Daiwa Seiko, Inc., Higashikurume-shi, Tokyo (JP)

( * ) Notice: Subject to any disclaimer, the term of this patent is extended or adjusted under 35 U.S.C. 154(b) by 142 days.

(21) Appl. No.: 12/219,964

(22) Filed: Jul. 31, 2008

(65) Prior Publication Data

US 2010/0035701 A1 Feb. 11, 2010

(30) Foreign Application Priority Data

Jul. 31, 2007 (JP) ..... P2007-200173
Sep. 12, 2007 (JP) ..... P2007-236678
Oct. 24, 2007 (JP) ..... P2007-276097
Jun. 27, 2008 (JP) ..... P2008-169027

(51) Int. Cl.
*A63B 53/02* (2006.01)

(52) U.S. Cl. ..... 473/288; 473/307; 473/309

(58) Field of Classification Search ..... 473/288, 473/305–312, 314, 296–299
See application file for complete search history.

(56) References Cited

U.S. PATENT DOCUMENTS 2,067,556 A * 1/1937 Wettlaufer ..... 473/308
2,219,670 A * 10/1940 Wettlaufer ..... 473/247
4,854,582 A * 8/1989 Yamada ..... 473/309
4,948,132 A * 8/1990 Wharton ..... 473/246
5,857,921 A * 1/1999 Braly et al. ..... 473/289
5,863,260 A * 1/1999 Butler et al. ..... 473/305
5,885,170 A * 3/1999 Takeda ..... 473/306
7,083,529 B2 * 8/2006 Cackett et al. ..... 473/309
7,335,113 B2 * 2/2008 Hocknell et al. ..... 473/307
7,351,159 B2 * 4/2008 Lai ..... 473/305
7,553,240 B2 * 6/2009 Burnett et al. ..... 473/288
2003/0181255 A1 * 9/2003 Ho ..... 473/316
2007/0173344 A1 * 7/2007 Burch ..... 473/305
2009/0011850 A1 * 1/2009 Stites et al. ..... 473/288
2010/0016094 A1 * 1/2010 Hocknell et al. ..... 473/288

FOREIGN PATENT DOCUMENTS

JP 2005-270402 10/2005

* cited by examiner

*Primary Examiner* — Stephen L. Blau
(74) *Attorney, Agent, or Firm* — McGinn IP Law Group, PLLC

(57) ABSTRACT

The invention provides a golf club including a clubhead including a hosel portion having an internal screw portion and a first support surface; a shaft including a neck portion having an external screw portion which screws into the first screw portion and a second support surface opposed to the first support surface, and an adjuster element adapted to be interposed between the first support surface and the second support surface when the clubhead and the shaft are screwed together by the first screw portion and the second screw portion being screwed together, wherein a center axis of an insertion portion on the internal thread is formed is inclined at a predetermined angle with respect to a center axis of the shaft which results when the clubhead and the shaft are screwed together.

19 Claims, 14 Drawing Sheets

GOLF CLUB

SUMMARY OF THE INVENTION

The present invention relates to a golf club and more particularly to a golf club in which clubheads and shafts can freely be replaced.

In golf clubs, there is disclosed in JP-A-2005-270402 a golf club in which clubheads and shafts can freely be replaced. A technique disclosed in JP-A-2005-270402 is such as not only to prevent the dropping-off of a shaft from a clubhead when the club is swung. Specifically, in this golf club, a shaft insertion hole of a non-circular cross-sectional shape is provided in a hosel portion where a shaft is tied up with a clubhead main body and a dropping-off preventive means is included for preventing the dropping-off of the shaft from a sole side of the clubhead main body. By this configuration, the position in a rotating direction of the clubhead relative to the shaft can be changed, as a result of which a lie angle and a loft angle can be made to be changed.

In the technique disclosed in JP-A-2005-270402, however, when the lie angle and the loft angle are changed repeatedly, angular portions of the non-circular shape (for example, an octagonal shape) are collapsed, whereby there may caused a fear that looseness is generated or the shaft sticks to the clubhead due to biting. Further, when a screw construction is adopted, there exists a problem that a positional relationship in the rotating direction between a shaft and a clubhead is not determined accurately.

SUMMARY OF THE INVENTION

The invention has been made in view of these points, and an object thereof is to provide a golf club in which replacement work of shafts and clubheads is eased, which has superior durability and which can determine a positional relationship in the rotating direction between a shaft and a clubhead with high accuracy.

In order to solve the above problem, the present invention provides the following arrangements.

(1) A golf club comprising:

a clubhead including a hosel portion having a first screw portion and a first support surface;

a shaft including a neck portion having a second screw portion which screws into the first screw portion and a second support surface opposed to the first support surface; and an adjuster element adapted to be interposed between the first and second support surfaces when the clubhead are fixed to the shaft by the first and second screw portions being screwed together, wherein a center axis of an inserting area on the first or second screw portion where an internal thread is formed is inclined at a predetermined angle with respect to a center axis of the shaft which results when the clubhead is fixed to the shaft.

(2) The golf club according to (1), wherein the adjuster element includes a plurality of adjuster elements which have different thicknesses, so that an attaching position in a rotating direction of the shaft to the clubhead can be selected by changing the adjuster elements.

(3) The golf club according to (2), wherein the plurality of adjuster elements includes a reference adjuster element for setting a reference position in the rotating direction of the shaft relative to the clubhead and a plurality of angle adjuster elements for increasing or decreasing proportionally an angle of the shaft relative to the clubhead from the reference position in a predetermined ratio.

(4) The golf club according to (1), wherein the adjuster element includes at least one adjuster element having a thickness larger than a screw thread pitch of the screw portion.

(5) The golf club according to (1), wherein one of the hosel portion and the neck portion forms an insertion hole and the other of the hosel portion and the neck portion forms an insertion portion inserted into the insertion hole.

(6) The golf club according to (5), wherein an insertion length of the insertion portion into the insertion hole in a state that the screw fitting of the first and second screw portions is released is set to be larger than a diameter of an opening of the insertion hole.

(7) The golf club according to (5), wherein an outside diameter of a portion of the insertion portion where the adjuster element lies which is interposed between the first and second support surfaces when the clubhead is fixed to the shaft is formed larger than outside diameters of other portions of the insertion portion.

(8) The golf club according to (5), wherein a vibration absorbing member which is softer than the hosel portion and the neck portion is interposed between the insertion hole and the insertion portion, respectively.

(9) The golf club according to (1), wherein an engagement portion with which a tool used when attaching or detaching the shaft to or from the clubhead is brought into engagement is formed on the neck portion.

(10) The golf club according to (1), wherein a space portion is formed in the hosel portion or the neck portion, so that a weight adjuster member is held in the space portion in a replaceable fashion.

(11) The golf club according to (1), wherein the shaft has a grip attached to an end of the shaft which is opposite to an end to which the clubhead is attached, and an external shape of at least an area of the grip which is gripped is formed into a circular shape in cross section.

(12) A golf club attaching and detaching system comprising:

at least one clubhead including a hosel portion;

a reference shaft including a neck portion forming a first fitting portion to be fitted to the hosel portion, a center axis of the first fitting portion and an axial center of the reference shaft being made to be oriented in the same direction;

at least one angled shaft including a neck portion forming a second fitting portion to be fitted to the hosel portion, a center axis of the second fitting portion is inclined at a predetermined angle with respect to an axial center of the angled shaft; and an angle adjusting mechanism that is used, when the angled shaft is attached to the clubhead, so that the angle adjusting mechanism is installed between the angled shaft and the clubhead fitted in the angled shaft for selecting a position in a rotating direction relative to the center axis of the second fitting portion.

(13) The system according to (12), wherein the angle adjusting mechanism includes a first support surface on the hosel portion and a second support surface opposed to the first support surface on the neck portion of the angled shaft, so as to restrict a motion to a direction along the center axis of the second fitting portion by the first and second support surfaces.

(14) The system according to (12), wherein the at least one angled shaft comprises a plurality of the angled shafts having different specifications.

(15) The system according to (12), wherein the at least one clubhead comprises a plurality of heads having different specifications.

(16) The system according to (12), wherein the hosel portion is formed with a first screw portion and the neck portion is formed with a second screw portion which screws to the first screw portion, and the angle adjusting mechanism includes an adjuster element which is interposed between the first and second support surfaces when the clubhead is fixed to the angled shaft by the first and second screw portions being screwed to each other.

(17) A golf club in which a neck portion of a shaft is fittingly attached to a hosel portion of a clubhead, wherein an angle adjuster element for adjusting an axial center of the shaft to a predetermined angle with respect to a center axis of the hosel portion is interposed between the hosel portion and the neck portion, the angle adjuster element being replaceable for the hosel portion and the neck portion.

(18) The golf club according to (17), comprising at least two angle adjuster elements which are a reference adjuster element for aligning an axial direction of the hosel portion with the center axis of the hosel portion and an angled angle adjuster element for causing the shaft and the hosel portion to form a predetermined angle between the axial center of the shaft and the center axis of the hosel portion.

(19) The golf club according to (17), wherein the hosel portion of the clubhead and the angle adjuster element, and the neck portion of the shaft and the angle adjuster element each comprise a rotation preventive mechanism for preventing rotation, and wherein the hosel portion and the neck portion comprise a dislocation preventive mechanism for preventing the occurrence of dislocation therebetween, whereby the clubhead and the angle adjuster element, and the angle adjuster element and the shaft each are made to be fittingly attached to each other in a detachable fashion.

(20) The golf club according to (19), wherein the rotation preventive mechanism has a play and looseness preventive mechanism for preventing the occurrence of play and looseness in the rotation preventive portion at least either between the hosel portion of the clubhead and the angle adjuster element or between the neck portion of the shaft and the angle adjuster element.

(21) The golf club according to (17), comprising a direction specifying mechanism for specifying an attaching direction of the shaft to the clubhead in one direction.

(22) The golf club according to (17), having a plurality of shafts which are different in at least one or more performances of shaft performances such as hardness, weight and length of shaft, each shaft being made to be detachably attached to the angle adjuster element or the hosel portion of the clubhead.

(23) The golf club according to (17), having a plurality of clubheads which are different in at least one or more performances of clubhead performances such as size, weight and position of center of gravity of clubhead, each clubhead being made to be detachably attached to the angle adjuster element or the neck portion of the shaft.

(24) The golf club according to (18), having a plurality of shafts which are different in at least one or more performances of shaft performances such as hardness, weight and length of shaft, wherein at least one of the plurality of angle adjuster elements is secured to a distal end portion of any of the shafts.

According to the invention, the golf club can be provided which facilitates the replacement work of the shaft and the clubhead, which has superior durability and which can determine a positional relationship in the rotating direction between the shaft and the clubhead with high accuracy.

According to the golf club attaching and detaching system according to the invention, the test striking of balls using various types of golf clubs with few clubheads and shafts is enabled so as to select easily a most suitable golf club.

According to the invention, the lie angle and the loft angle of the golf club in which the shaft and the clubhead can be detachably attached can easily be adjusted to a desired angle.

BRIEF DESCRIPTION OF THE DRAWINGS

FIGS. 1A and 1B are drawings showing a golf club according to an embodiment of the invention, in which FIG. 1A is a view in which a face portion is oriented to the front, and FIG. 1B is a view in which a toe portion is oriented to the front.

DETAILED DESCRIPTION OF PREFERRED EMBODIMENTS

Hereinafter, embodiments of the invention will be described in detail by reference to the accompanying drawings.

First Embodiment

Figure 1A:
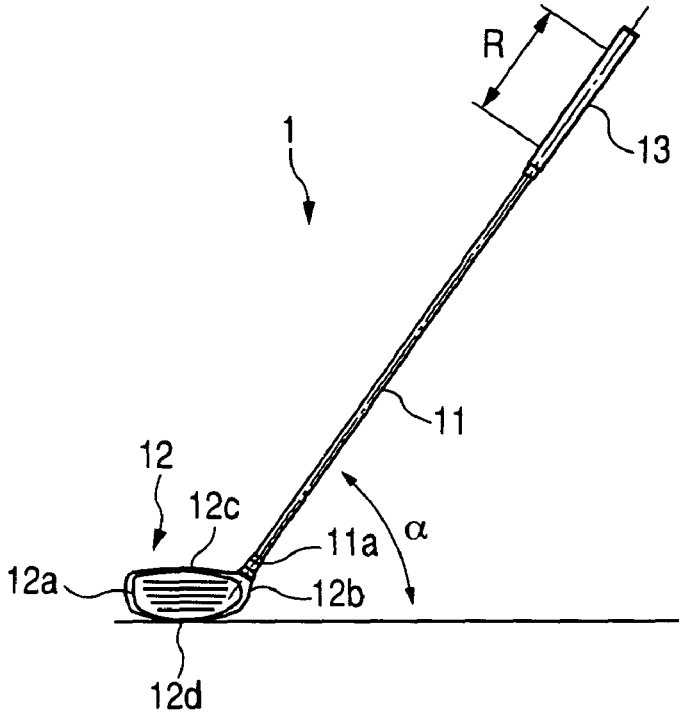
Figure 1B:
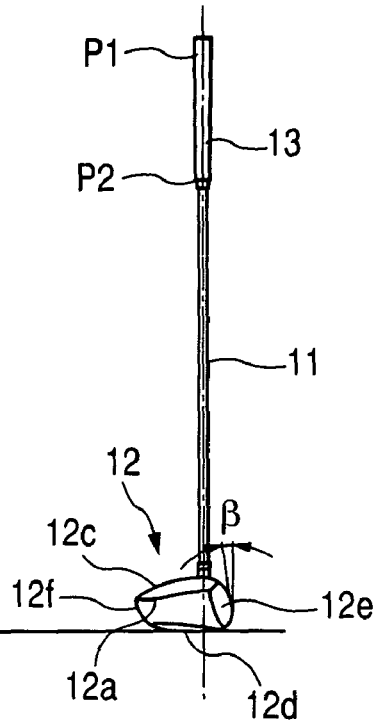

FIGS. 1A and 1B show a golf club according to a first embodiment of the invention, in which FIG. 1A is a view with a face portion oriented to the front and FIG. 1B is a view with a toe portion is oriented to the front.

A golf club 1 shown in FIGS. 1A and 1B is configured by screwing a clubhead 12 which is set to a predetermined lie angle α relative to a reference horizontal plane and a predetermined loft angle β on to a distal portion of a shaft 11 which is made of metal or FRP. Note that when used herein, the "loft angle" is such as to be called a "real loft" and specifically, a loft angle which results when a predetermined lie angle α is set and a face angle is made to be 0°. A neck portion 11*a* is provided at a distal end of the shaft 11, and the clubhead 12 is made to be attached to the neck portion 11. This neck portion 11*a* is formed integrally with or separately from the shaft 11. When the neck portion 11*a* is formed integrally, the neck portion 11*a* may be formed directly on the shaft 11 or the neck portion 11*a* may be formed integrally through insert molding when the shaft is molded. Further, a grip 13 made of a flexible and soft material such as natural rubber or synthetic rubber is attached to a proximal end of the shaft 11. Additionally, a socket 11*b* is formed integrally on the shaft 11 for filling a difference in level between the shaft 11 and the neck portion 11*a*.

The grip 13 is preferably such that an external shape of an area which is at least actually gripped by the golfer (an area denoted by reference character R in FIG. 1A, which is an area extending 20 mm to 180 mm from a grip end) is formed into a circular shape in cross section. Specifically, the portion in question of the shaft is preferably formed into a true circle in terms of thickness and external shape so that the same gripping feeling can be obtained in any position through 360° when the shaft 11 is rotated (however, the true circle here only has to be to such accuracy as to provide a grip state in which a feeling of physical disorder is made difficult to be felt by the golfer when he or she grips the shaft 11, or a grip state which is generally referred to as a "grip with no back seam"). Further, the hardness is also preferably made uniform in the circumferential direction. By configuring the grip 13 in this way, the same gripping sensation can be obtained in any position when the shaft 11 is rotated. Further, since a proximal end portion and a distal end portion (portions other than the area denoted by R) of the grip 13 are portions which are not gripped by the golfer, an arbitrary shape may be adopted thereat.

In the clubhead 12, in such a state that the clubhead 12 is placed on the ground as is shown in FIG. 1A, a toe portion 12*a* is situated in a position relatively spaced apart from the shaft 11, a heel portion 12*b* is situated in a position near the shaft 11, a crown portion 12*c* is situated at a top side, and a sole portion 12*d* is situated at a bottom side. Further, as is shown in FIG. 1B, a face portion 12*e* which strikes a ball is provided on the clubhead 12. Additionally, a back portion 12*f* is situated on an opposite side to the face portion 12*e*.

In the clubhead 12, the other portions excluding a face material that is secured to the face portion 12*e* are preferably formed integrally through casting using, for example, a titanium alloy (Ti-6Al-4V, Ti-15V-3Cr-3Sn-3Al), an iron-based alloy (17-4ph, SUS304), or Custum450 (made by Carpenter Inc.), and an opening to which the face material which makes up a striking surface is secured is formed on a front surface side of the face portion 12*e*. Further, the clubhead 12 may be formed by forming first respective constituent members and then fixing them together through welding, bonding or the like. The face material which is secured on to the face portion 12*e* is preferably formed integrally by pressing, for example, a titanium alloy (Ti-15V-3Cr-3Sn-3Al, Ti-6Al-4V, SP700, Ti-15V-6Cr-4Al, Ti-15Mo-5Zr-3Al), an iron-based alloy (Custom455, 466 (made by Carpenter Inc.), 18Ni-12Co-4, 5Mo-1.5Ti—Fe) or Ti-30Nb-10Ta-5Zr into a plate shape (and furthermore, a milling treatment may be applied thereto). The face material so formed is fitted in the opening formed on the face portion 12*e* and is then secured thereto through bonding, welding and brazing. Further, the face portion 12*e* may be formed integrally with the clubhead 12 without fitting the face material which is a separate member in the opening formed thereon, or the whole of the face portion 12*e* may be made up of a face material which is separate from the clubhead 12.

Figure 2:
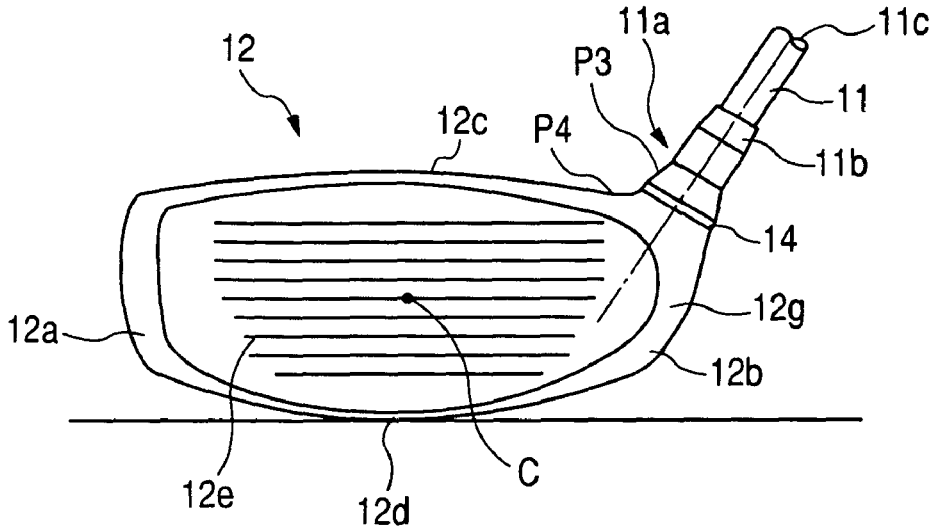
FIG. 2 is an enlarged view of a clubhead of the golf club shown in FIG. 1.

FIG. 2 is an enlarged view showing the clubhead of the golf club shown in FIGS. 1A and 1B.

According to the invention, when the clubhead 12 is attached to the shaft 11, a position in a rotating direction relative to the center axis of the fitting portion can be selected by an angle adjusting mechanism 10. Hereinafter, the configuration of the shaft 11 and the configuration of the angle adjusting mechanism 10 according to the first embodiment will be described below. The clubhead 12 has a hosel portion 12*g* provided thereon where the shaft 11 is directly or indirectly attached thereto. A neck portion 11*a* of the shaft 11 is attached to the hosel portion 12*g* via an adjuster element 14 (forming the angle adjusting mechanism 10) through screwing. In FIG. 2, reference numeral 11*b* denotes a socket, and reference numeral 11*c* denotes a center axis of the shaft. Further, reference character C denotes a face center, which constitutes a center of a height of the face surface and a center of a face width. This face center constitutes a measuring point when measuring a "loft angle" and a "face angle."

Figure 3:
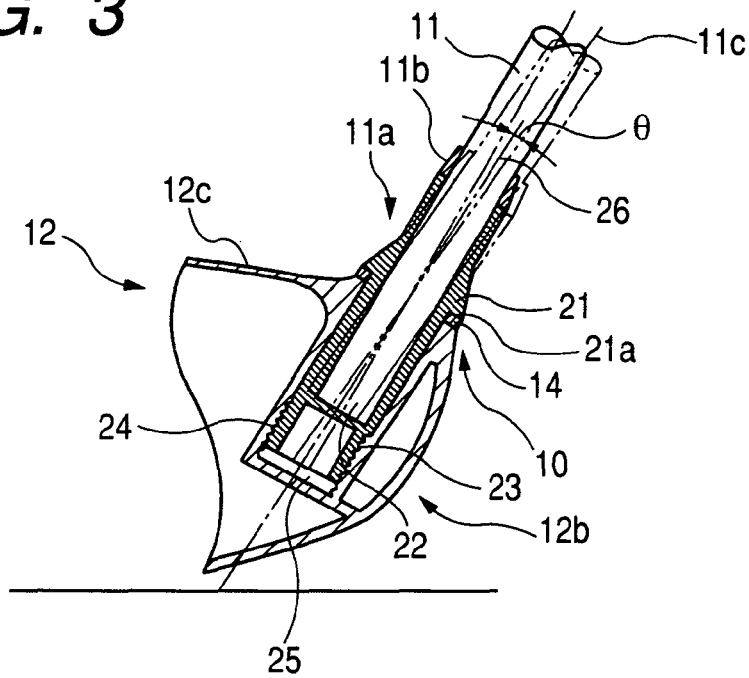
FIG. 3 is an enlarged view showing a neck portion of the clubhead of the golf club shown in FIG. 1.

FIG. 3 is an enlarged view showing the neck portion of the clubhead of the golf club shown in FIGS. 1A and 1B. The neck portion 11*a* of the shaft 11 is configured by placing the neck portion 11*a* at a distal end of the shaft 11. This neck portion 11*a* has a large-diameter portion 21 whose diameter is reduced from a distal end side to a proximal end side. A flange face 21*a* is provided at a distal end portion of the large-diameter portion 21, and this flange face 21*a* constitutes a first support surface of the hosel portion 12*g* or a second support surface which is brought into abutment with the adjuster element 14. The adjuster element 14 is provided in a position where the flange surface 21*a* is so provided. Further, an external thread 24 is formed at a distal end of the neck portion 11*a* so as to screw into the hosel portion 12*g*.

On the other hand, an insertion hole 22 into which the neck portion 11*a* of the shaft 11 is inserted is formed in the hosel portion 12*g* of the clubhead 12. This insertion hole 22 has such a sufficient size that the neck portion 11*a* of the shaft 11 is inserted thereinto to be screwed in place therein. An internal thread 23 is formed on an inner circumferential surface of the insertion hole 22 in such a manner as to screw on to the external thread 24 of the neck portion 11*a*.

When connecting together the shaft 11 and the clubhead 12 which are configured as has been described above, the neck portion 11*a* of the shaft 11 is inserted into the insertion hole 22 of the clubhead 12, and the shaft 11 is rotated, whereby the external thread 24 of the neck portion 11*a* screws in the internal thread 23 of the insertion portion 22, and the neck portion 11*a* of the shaft 11 screws into the hosel portion 12*g* of the clubhead 12. In such a state that the shaft 11 is attached to the clubhead 12 in this way, a center axis 26 of the insertion hole 22 on which the internal thread 23 is formed is inclined at a predetermined angle θ with respect to a center axis 11*c* of the shaft 11. This angle θ is preferably set in the range of 0.5 degree to 5 degrees in consideration of a changing range of the lie angle and the loft angle. However, the angle θ is not limited to this range and can be set to a value which falls out of the range as required. Further, a space 25 is provided between a distalmost end portion of the neck portion 11*a* and a bottom surface of the insertion hole 22. This space 25 is set so that the distalmost end portion of the neck portion 11*a* and the bottom surface of the insertion hole 22 do not come into contact with each other even though the adjuster element 14 is not interposed between the hosel portion 12*g* and the neck portion 11*a*. Further, as to thread directions of the external thread 24 and the internal thread 23, it is preferable that a "backward thread" is used for a golf club for a right-handed player and a "forward thread" is used for a golf club for a left-handed player. By adopting these configurations, the clubhead 12 is firmly fastened to the shaft 11 by a ball when it is struck, whereby the loft angle and the lie angle are stabilized.

Figure 4:
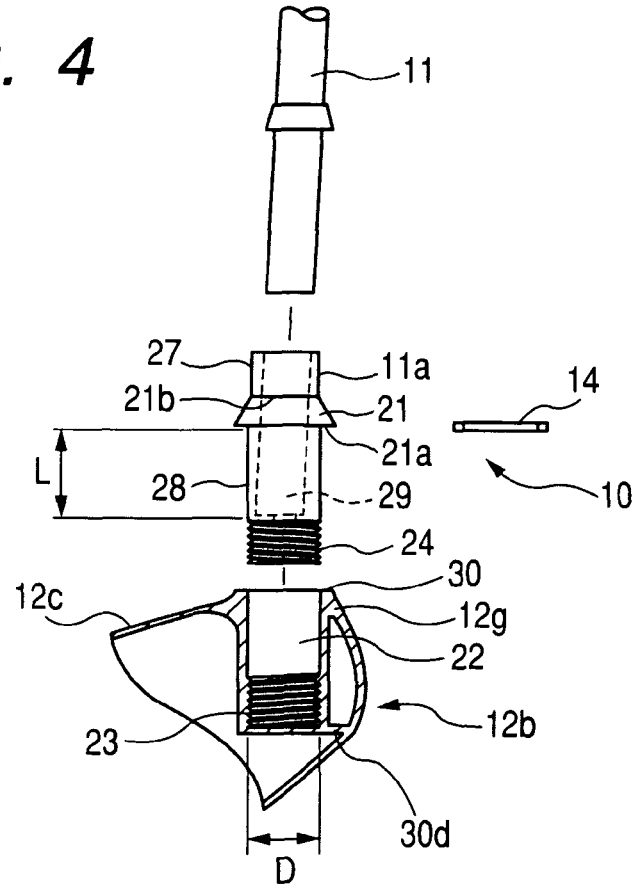
FIG. 4 is an exploded view describing how to connect a hosel portion and the neck portion.

FIG. 4 is an exploded view which illustrates how the hosel portion and the neck portion are connected together. More specifically, the neck portion 11*a* is made up mainly of an external extended portion 27 into which the shaft 11 is inserted, the large-diameter portion 21 which is provided at a distal end side of this external extended portion 27, an insertion portion 28 which is provided consecutively to a distal end side of the large-diameter portion 21 for insertion into the insertion hole 22 in the hosel portion 12*b* and the external thread 24 formed at the distal end of the insertion portion 28. The flange surface 21*a* formed on the large-diameter portion 21 constitutes a support surface which is brought into abutment with the adjuster element 14 or the first support surface 30 of the hosel portion 12*g*. Further, a shaft fitting hole 29 is provided in the neck portion 11.

The hosel portion 12*g* is made up mainly of the insertion hole 22 into which the insertion portion 28 of the neck portion 11*a* is inserted, the internal thread 23 which is formed on the inner circumferential surface of the insertion hole 22 to screw on to the external thread 24 of the neck portion 11*a* and the first support surface 30 which is brought into abutment with the adjuster element 14 or the hosel portion 12*g*. Further, a connecting portion 30*d* is provided at the bottom surface of the insertion hole 22 of the hosel portion 12*g* in such a manner as to extend towards the heel portion 12*b*. By providing the connecting portion 30*d*, the strength of the hosel portion 12*g* can be increased. This connecting portion may be provided on the sole portion. Further, this connecting portion 30*d* may not be provided.

In the first embodiment, the insertion hole 22 means a shaft attaching hole provided in the hosel portion 12*g*. Consequently, in the hosel portion 12*g*, although the position of a top portion (the first support surface 30) of the insertion hole 22 may be higher than the crown portion 12*c*, by setting the position in question to be lower than the crown portion 12*c* the shape of the golf club becomes well-shaped when the golfer is in the address position (that is, the shape which allows the golfer to take an address position with ease or which does not make the golfer feel the sensation of physical disorder when he or she is in the address position).

The second support surface 21*a* of the neck portion 11*a* and the first support surface 30 of the hosel portion 12*g* can bear each other via the adjuster element 14. Moreover, since areas and outside diameters of the support surfaces can be set arbitrarily independently of the screw portions, the deformation and wear can be suppressed which would otherwise be produced as a result of repeated use, and the occurrence of a situation can be prevented in which the shaft 11 and the clubhead 12 become difficult to be detached from each other due to biting.

Further, in this configuration, since the insertion portion 28 of the neck portion 11*a* is made to be inserted into the insertion hole 22 of the hosel portion 12*g*, the occurrence of looseness can be prevented which would otherwise be the case when the shaft 11 is attached to the clubhead 12, thereby making it possible for the shaft 11 to be attached to the clubhead 12 with good accuracy. Further, it is preferable to form raised portions partially along an outer circumference of the insertion portion 28 because the adjuster element 14 can be held by the outer circumference of the insertion portion 28 when the adjuster element 14 is interposed.

Further, a distal end side of the external thread 24 formed on the insertion portion 28 is preferably made relatively thick. By adopting this configuration, a fatigue failure due to repeated application of torsional stress and tensile stress can be prevented. Further, the external thread 24 is preferably formed at the distal end side of the insertion portion. By adopting this configuration, the insertion portion 28 is made longer, and the shaft 11 can be attached to the clubhead 12 with better accuracy. Further, when the external thread 24 is provided at a proximal end side of the insertion portion 28, the length of the external thread 24 is preferably made longer than the length of the insertion portion 28.

Further, as is shown in FIG. 4, the insertion hole 22 formed in the hosel portion 12*g* and the neck portion 11*a* that is inserted into the insertion hole 22 are preferably such that an insertion length L of the neck portion 11*a* at the distal end of the shaft relative to the insertion hole 22 in the hosel portion (an insertion length of a portion where the external thread 24 is not formed) is set to be larger than a diameter D of an opening of the insertion hole 22 in such a state that the screwed engagement between the internal thread 23 on the hosel portion 12*g* and the external thread 24 on the neck portion 11*a* is released.

By adopting this configuration, when detaching the clubhead 12 from the shaft 11, in particular, even when the screwed engagement between the shaft and the clubhead is released by rotating the clubhead 12 with the shaft 11 oriented in such a manner that the grip is placed downwards and the clubhead 12 placed upwards, since the insertion length L is longer than the diameter D of the insertion hole 22, the insertion portion can stay within the insertion hole 22, whereby the clubhead 12 is allowed to be maintained within the neck portion 11*a* at the distal end of the shaft 11. By this configuration, the clubhead 12 can be prevented from being damaged or failed due to an erroneous fall thereof. In this case, by setting the aforesaid relationship between L and D to $L>1.2D$ or preferably $L>1.5D$ the fall of the clubhead can be prevented effectively.

When forming the external thread 24 on the neck portion 11*a*, it is preferable to perform a thread cutting operation under totally the same conditions using the second support surface 21*a* as a reference. Further, when forming the internal thread 23 on the hosel portion 12*g*, it is preferable to perform a thread cutting operation under totally the same conditions.

As to the screw portion of the hosel portion 12*g*, an internal thread formed as a separate element or a screw portion including a hosel portion may be aligned with and then attached to the hosel portion 12*g* through bonding or welding.

As is shown in FIG. 4, the shaft fitting hole 29 is provided in an interior of the neck portion 11*a*. This shaft fitting hole 29 has such a sufficient size that the shaft 11 is fitted therein. Further, the shaft fitting hole 29 is formed in such a manner that a center axis thereof is inclined at a predetermined angle θ with respect to a center axis of the insertion portion 28. Namely, since the shaft 11 is fitted in along the shaft fitting hole 29 and the insertion portion 28 screws into the insertion hole 22, a center axis of the insertion hole 22 is inclined at the predetermined angle θ with respect to a center axis of the shaft 11 when the clubhead 12 and the shaft 11 are screwed together. Note that in this specification, the insertion hole and/or the area of the internal thread 23 is referred to as an inserting area.

When the shaft fitting hole 29 is formed in such a manner that the center axis thereof is inclined at the predetermined angle θ with respect to the center axis of the insertion portion 28, for example, as is shown in FIG. 4, an axis which intersects a proximal end side surface 21*b* of the large-diameter portion 21 at right angles is made to be inclined at the predetermined angle θ relative to the center axis of the insertion portion 28. By adopting this configuration, when the insertion portion 28 is inserted into the insertion hole 22 of the hosel portion 12*g*, the center axis of the insertion portion 28 coincides with the center axis of the insertion hole 22, and moreover, when the shaft 11 is fitted in the shaft fitting hole 29, the center axis of the shaft 11 is inclined at the predetermined angle θ relative to the center axis of the insertion portion 28. Further, in the first embodiment, the configuration is described in which by making the axis, which intersects the proximal end side surface 21*b* of the large-diameter portion 21 at right angles, inclined at the predetermined angle θ relative to the center axis of the insertion portion 28, when the insertion portion 28 is inserted into the insertion hole 22 of the hosel portion 12*g*, the center axis of the insertion portion 28 and the center axis of the insertion hole 22 coincide with each other, and, when the shaft 11 is fitted in the shaft fitting hole 29, the center axis of the shaft 11 is inclined at the predetermined angle θ with respect to the center axis of the insertion portion 28. However, in the first embodiment, a configuration may be adopted by utilizing either portion or member of the neck portion 11*a* and/or the hosel portion 12*g* in which when the insertion portion is inserted into the insertion hole 22 of the hosel portion 12*g*, the center axis of the insertion portion 28 and the center axis of the insertion hole 22 coincide with each other, and, when the shaft 11 is fitted in the shaft fitting hole 29, the center axis of the shaft 11 is inclined at the predetermined angle with respect to the center axis of the insertion portion 28.

When the shaft 11 is attached to the neck portion 11*a*, for example, the distal end of the shaft 11 is fitted in the shaft fitting hole 11 formed on a proximal end side of the external extended portion 27 and is then fixed in place through bonding or the like. Further, a configuration may be adopted in which the external extended portion 27 is formed solid and the external extended portion 27 so formed is then fitted in a hollow portion of the shaft 11 to be fixed in place therein.

When the neck portion 11*a* that is configured as described above is screwed into the hosel portion 12*g*, the center axis of the shaft 11 is inclined at the predetermined angle θ relative to the center axis of the insertion portion 28 in an in-use state in which the second support surface 21*a* of the neck portion 11*a* is in abutment with the first support surface 30 of the hosel portion 12*g*. By making the center axes inclined at the angle in the way described above, a position between the shaft 11 and the rotating direction of the clubhead 12 can be set with good accuracy by a replacement of adjuster elements, which will be described later, whereby fine adjustments of the lie angle and the loft angle can be carried out. As a result, without preparing many types of clubheads test striking can be implemented while changing the lie angle and the loft angle, and a golf club having desired lie angle and loft angle can be provided to a customer based on the results of the test striking.

Although in particular, pure titanium, a titanium alloy such as Ti-15V-3Cr-3Sn-3Al and an aluminum alloy such as 6061, 7075 are preferable for a material which makes up the neck portion 11*a* in consideration of low specific weight, strength and wear resistance, an iron alloy or a high-strength resin may be used. Further, when aluminum alloys are used, an anodizing treatment is preferably applied thereto in order to prevent electric corrosion. Further, when screwing the neck portion 11*a* into the hosel portion 12*g* or, on the contrary, unscrewing the neck portion 11*a* from the hosel portion 12*g* for detachment, the external extended portion 27 of the neck portion 11*a* is preferably made to have a gripping facilitating construction on an external surface thereof. Specifically, as with a fifth embodiment shown in FIG. 12 which will described later, an engagement portion is preferably formed with which a tool for use in attaching or detaching the shaft to or from the clubhead is brought into engagement. An engagement portion like this can be made up of flat surface portions, holes, ribs or irregularities with which such a tool is brought into abutment, and in particular, a polyhedral portion such as a hexahedral portion is formed, and a marking is preferably given to one side of the polyhedral portion with a view to identifying an inclined direction of the shaft.

Figure 5:
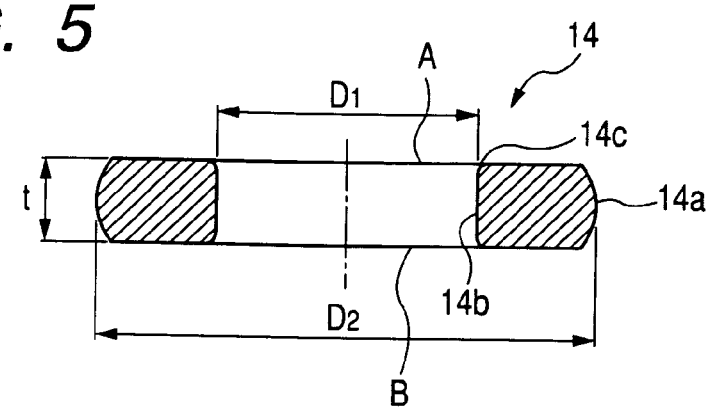
FIG. 5 is a sectional view showing an adjuster element of the golf club according to the embodiment of the invention.

Next, the adjuster element 14 will be described. FIG. 5 is a sectional view showing the adjuster element of the golf club according to the first embodiment of the invention. The adjuster element 14 has a substantially ring shape and is attached to the insertion portion 28 of the neck portion 11*a*. The adjuster element 14 has a pair of surfaces, a surface A and a surface B, opposed to each other and the surface A and the surface B are substantially parallel. Further, the adjuster element 14 includes an outer surface 14*a*, an inner surface 14*b* into which the insertion portion 28 is inserted and guide surfaces 14*c* which are provided on a surface A side and a surface B side of the inner surface 14*b*, respectively.

The outer surface 14*a* of the adjuster element 14 preferably has a shape in which a center is made to swell out in a thickness direction. By adopting this configuration, an attaching or detaching operation of the adjuster element 14 is facilitated. Further, the guide surfaces 14*c* are provided to facilitate the insertion of the insertion portion 28 when the insertion portion 28 of the neck portion 11*a* is inserted into or passed through the adjuster element 14, and when taking into consideration the function, the guide surfaces 14 are preferably make up of an inclined surface or a curved surface.

In FIG. 5, $D_1$ denotes an inside diameter, $D_2$ denotes an outside diameter, and t denotes a thickness. The inside diameter D1 is preferably set so that the insertion portion 28 of the neck portion 11*a* can be attached or detached freely to the hosel portion 12*g* therethrough with little looseness. Further, the thickness t is preferably to such a thickness that the handling of the adjuster element 14 is facilitated, for example, in the range of 0.1 mm to 10 mm and more preferably in the range of 0.3 mm to 5 mm. Further, a tolerance of the thickness t is preferably set to be equal to or less than +/−0.05 (0.003).

A material which is harder than the material from which the clubhead 13 is made is preferably used for the material from which the adjuster element 14 is made in consideration of wear resistance. Because of this, a harder material which is harder than the material from which the clubhead 12 is formed may be worked to make up the adjuster element 14, or a heat treatment may be applied after the adjuster element 14 has been made from a specific material so as to make the material harder than the material which makes up the clubhead 12. Specifically, pure titanium, a titanium-alloy such as Ti-6Al-4V, Ti-15V-3Cr-3Sn-3Al or the like, or an iron-based alloy is preferable. Further, a resin having high wear resistance may be used, and as this occurs, electric corrosion can be prevented.

Next, how to use the adjuster element in the golf club of the invention will be described.

Figure 6:
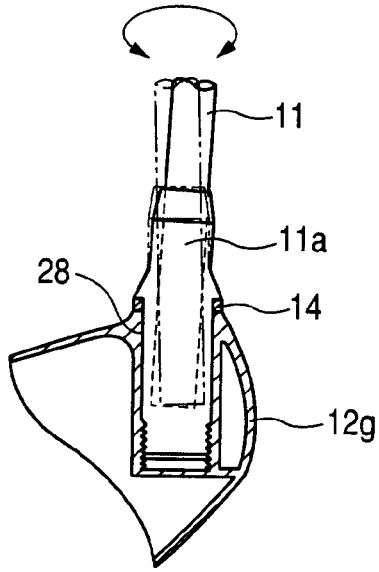
FIG. 6 is a drawing describing how to adjust the angle of the adjuster element of the golf club according to the embodiment of the invention.

FIG. 6 is a drawing which describes the angle adjustment of the adjuster element in the golf club according to the first embodiment of the invention. In the golf club shown in FIG. 6, as has been described above, the center axis of the insertion portion 28 and the center axis of the insertion hole 22 coincide with each other, and the center axis of the shaft 11 is inclined at the predetermined angle with respect to the center axis of the insertion portion 28. In this configuration, when the shaft 11 is rotated, the center axis of the shaft 11 rotates in directions indicated by arrows in FIG. 6. By the neck portion 11*a* being rotated while making use of this principle, the relationship between the clubhead 12 and the shaft 11 can be set at an arbitrary angle through 360 degrees (one rotation) in the shaft direction. Namely, the lie angle and loft angle of the golf club can be set arbitrarily by these rotations. In this case, the position in the rotating direction (the rotational angle) can be adjusted by the thickness of the adjuster element 14.

Figure 7:
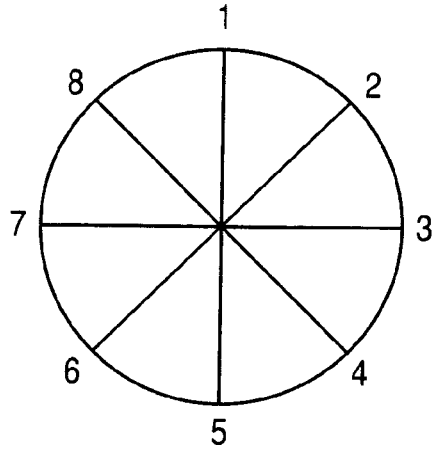
FIG. 7 is a drawing showing a relationship between the adjuster element (thickness) and a rotating angle.

FIG. 7 is a drawing which describes a relationship between the adjuster element (thickness) and the rotational angle. In FIG. 7, directions of "1" to "8" denote directions of the grip side of the shaft 11 relative to the center axis 26 of the insertion hole 22 of the clubhead 22. Here, a case will be described in which an attaching position of the shaft 11 to the clubhead 12 in the rotating direction is selected by utilizing eight adjuster elements having different thicknesses while replacing them. Further, there is imposed no specific limitation on the number of adjuster elements 14, and hence, the attaching position of the shaft 11 to the clubhead 12 in the rotating direction may be made to be selected using other numbers of adjuster elements than eight. For example, as is shown in FIG. 7, when one rotation (360 degrees) is divided equally into eight, the thickness can be adjusted by setting a dimension resulting by dividing one pitch of the thread equally into eight to the thickness of each of the adjuster elements 14. Namely, as is shown in Table 1 below, the dimension resulting by dividing one pitch of the thread equally into eight is set to the thickness of each of the adjuster elements 14 for each rotating angle. Since various lie angles and loft angles can be realized by interposing the adjuster elements having different thicknesses between the neck portion 11*a* and the hosel portion 12*g*, various lie angles and loft angles can be realized only by replacing the adjuster elements. Namely, a set (a necessary number) of adjuster elements may only have to be prepared, and when test striking by changing the lie angle and the loft angle, since many clubs having different specifications do not have to be prepared, space for many such clubs does not have to be secured or the player does not have to be troubled in carrying them, the handling of the club thereby becoming convenient largely. Note that in reality, the face angle changes associated with a change in the loft angle. Because of this, an adjustment can be implemented in which importance is placed on the face angle.

TABLE 1

Example of Adjustment by Adjuster Elements (using the eight-equal-dividing method)

Figure 8A:
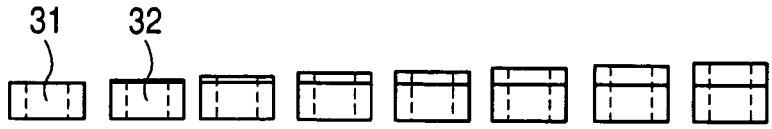
FIGS. 8 A to 8C are drawings showing examples of sets of adjuster elements.
Figure 8B:
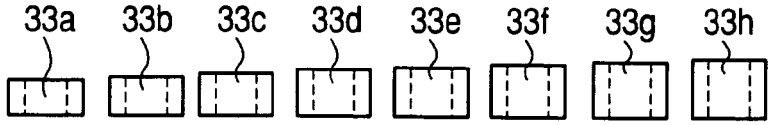
Figure 8C:
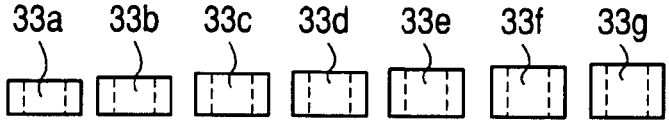

| No. | Rotating angles (compared to reference position) | Increase in thickness (compared to reference position) | Examples (unit mm) | | | Inclination θ (example of 2 degrees) | | |
|---|---|---|---|---|---|---|---|---|
| | | | Example of FIG. 8A | Example of FIG. 8B | Example of FIG. 8C | lie angle | loft angle | face angle |
| 1 | 0 degree (reference position) | 0 (reference thickness) | (5 mm) reference | (5 mm) reference | with no adjuster element | 60.0° | 12.0° | 0 |
| 2 | 45 degrees | +1/8XP | 0.1875 | 5.1875 | 3 mm reference plus two pitches | 59.4° | 10.6° | 1.8° |
| 3 | 90 degrees | +2/8XP | 0.375 | 5.375 | 3.375 | 58.0° | 10.0° | 2.6° |
| 4 | 135 degrees | +3/8XP | 0.25625 | 5.5625 | 3.5625 | 56.6° | 10.6° | 1.8° |
| 5 | 180 degrees | +4/8XP | 0.75 | 5.75 | 3.75 | 56.0° | 12.0° | 0° |
| 6 | 225 degrees | +5/8XP | 0.9375 | 5.9375 | 3.9375 | 56.6° | 13.4° | −1.8° |
| 7 | 270 degrees | +6/8XP | 1.125 | 6.125 | 4.125 | 58.0° | 14.0° | −2.6° |
| 8 | 315 degrees | +7/8XP | 1.13125 | 6.3125 | 4.3125 | 59.4° | 13.4° | −1.8° |

Note 1)

P: length of one pitch of thread (in the examples above, one pitch is 1.5 mm)

Note 2)

lie angle, loft angle and face angle are those when the inclination angle is 2 degrees. Numeric values other than those shown above may be selected for thread pitch and shaft inclination angle. In addition, other divisions than the eight equal division may be arbitrarily used including four equal division, six equal division and the like.

Note 3)

face angle is an angle formed by the face surface relative to a direction which intersects the center axis of the shaft at right angles. Slice face is indicated by + sign, while hook face is indicated by − sign.

As a set of adjuster elements 14 like one described above, sets shown in FIGS. 8A to 8C are raised, for example. FIG. 8A shows an adjuster element set of adding type, and in this set of adjuster element, the thickness is made to be adjusted by superimposing an angle adjuster element 32 on a reference adjuster element 31. Namely, this adjuster element set includes the reference adjuster element 31 which sets the position in the rotating direction of the shaft 11 relative to the clubhead 12 and a plurality of angle adjuster elements 32 which increase or decrease from the reference position the angle of the clubhead 12 relative to the shaft 11 in a proportional fashion in a predetermined ratio. By using the adjuster element set, the reference position and specification can be confirmed correctly, and a matching relationship between a change in lie angle or loft angle from the reference and the swing of a customer who carried out a test striking can easily be recognized.

In this case, the reference adjuster element 31 may have a larger thickness than the pitch of the screw portion. Further, two or more adjuster elements having the larger thickness than the pitch of the screw portion may be included in the set. By this configuration, the handling of the adjuster elements is facilitated, and the replacement work of the clubhead and the shaft can be performed smoothly.

As to the adjuster element set, FIG. 8B shows an adjuster element set of separate type, and this adjuster element set may be configured such that adjuster elements made, respectively, of the pairs of reference adjuster element+angle adjuster element shown in FIG. 8A are formed integrally to prepare separate adjuster elements 33*a* to 33*h* for the respective thicknesses. Further, FIG. 8C shows an adjuster element set which may be configured such that only one of eight angular positions is set as a position where no adjustment element is provided and adjuster elements adopting the system shown in FIG. 8A or 8B are provided for the other angular positions. Furthermore, since the adjuster elements are preferably made to be easily recognized from their external appearances in increasing from the view point of customer service, "color differentiation" or "marking on an external surface" is preferably implemented.

Further, identification designs, that is, symbols, markings, characters and the like which can identify angular directions of the center axis of the inserting area and the center axis of the shaft are preferably imparted to appropriate locations of the shaft 11 and the clubhead 12. By the identification designs being imparted in this way, the player can be made to understand the angular directions and hence the setting conditions of loft angle and lie angle. This identification design is preferably placed in a position which becomes easily visible to the player when he or she looks at the club at the front thereof towards the toe portion in the address position. Specifically, as is shown in FIGS. 1A to 2, for example, the identification design can be imparted to a proximal portion P2 at the front of the grip 13, a distal portion P1 of the grip 13, or a front portion P3 of the large-diameter portion 21 of the neck portion 11*a*, a front portion P4 of the hosel portion 12*g* or the like. Alternatively, the identification design may be imparted to a position which indicates a largest or least inclination angle.

Further, as has been described above, since the external shape of the area (the area denoted by reference character R in FIG. 1A) of the grip 13 which is actually gripped by the golfer is formed into the circular shape in cross section, the same gripping sensation (the gripping sensation which generates no feeling of physical disorder irrespective of position) can be obtained at any position round 360 degrees when the shaft 11 is rotated. Because of this, the player can make a more appropriate evaluation.

As has been described heretofore, in the golf club according to the first embodiment of the invention, even though the golf club is used repeatedly, biting and wear can be prevented by fastening in the rotating direction through screwing and locking in position in the axial direction by the first support surface and the second support surface, whereby the golf club which has superior durability can be realized. Further, by the adjuster element 14 being interposed between the first support surface and the second support surface, the clubhead 12 and the position in the rotating direction of the shaft 11 can be set in the desired direction, and the golf club is made durable against the repeated use so as to maintain the accuracy. Furthermore, since the clubhead 12 can be set in the desired direction by selection from the adjuster elements 14, the replacement work of the shaft 11 and the clubhead 12 can be implemented smoothly.

Further, since the angle adjusting mechanism 10 that has been described above implements an angle adjustment through locking in position in an axial direction by the first support surface 30 and the second support surface 21*a*, the angle adjusting mechanism 10 can restrict the motion of the angled shaft 11B and the clubhead 12 to the direction of the center axis in an ensured fashion, and the generation of looseness and resulting rattling during the test striking can be prevented, thereby making it possible to carry out a comparison test with high accuracy. Further, since locking in position is implemented in the axial direction, the sticking of the fitting portion can be prevented, whereby the attaching and detaching system of a clubhead and shafts can be provided which facilitates the attachment and detachment of the clubhead and which is easy to be operated.

In particular, with the angle adjusting mechanism 10 configured as has been described above, when locking in position in the axial direction is implemented by the first support surface 30 and the second support surface 21*a*, the clubhead 12 is easily operated to be attached or detached through fastening in the rotating direction by means of screwing (the screwed relationship between the external thread 24 and the internal thread 23), whereby even though the clubhead 20 and the shaft to which the clubhead 20 is attached are used repeatedly, the generation of sticking can be prevented, and a highly accurate test is enabled under stable conditions. Further, by the adjuster element 14 being interposed between the first support surface and the second support surface, the head and the position in the rotating direction of the shaft can be set in desired directions, whereby not only can the lie angle, loft angle and face angle be set to desired conditions but also the accuracy can be maintained by withstanding the repeated use.

The invention is not limited to the above embodiment that has been described above but can be carried out by being modified variously. For example, as to the connecting configuration between the hosel portion and the neck portion, the center axis of the inserting area of the screw portion where the internal thread is formed and the center axis of the shaft which results when the clubhead and the shaft are screwed together may only have to be set to have the predetermined angle formed therebetween.

Second Embodiment

Figure 9:
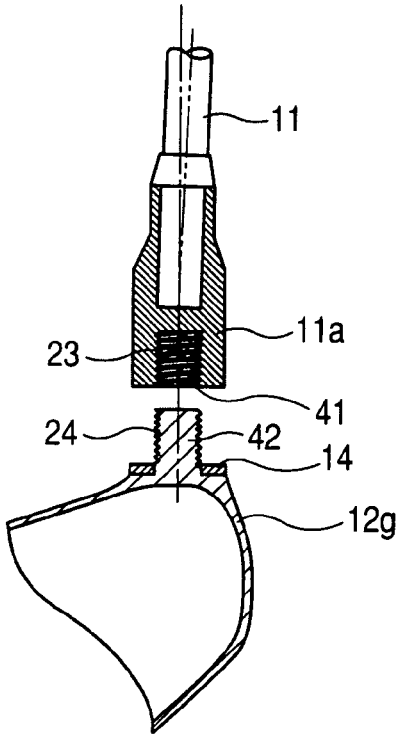
FIG. 9 is an exploded view describing another example of how to connect a hosel portion and a neck portion.

For example, as is shown in FIG. 9, a configuration may be adopted in which an insertion hole 41 is formed in the neck portion 11*a*, an internal thread 23 is formed on an inner circumferential surface of the insertion hole 41, a projecting portion 42 is formed on the hosel portion 12*g*, and an external thread 24 is formed on an outer circumferential surface of the projecting portion 42, whereby the neck portion 11*a* and the hosel portion 12*g* are screwed together.

Third Embodiment

Figure 10:
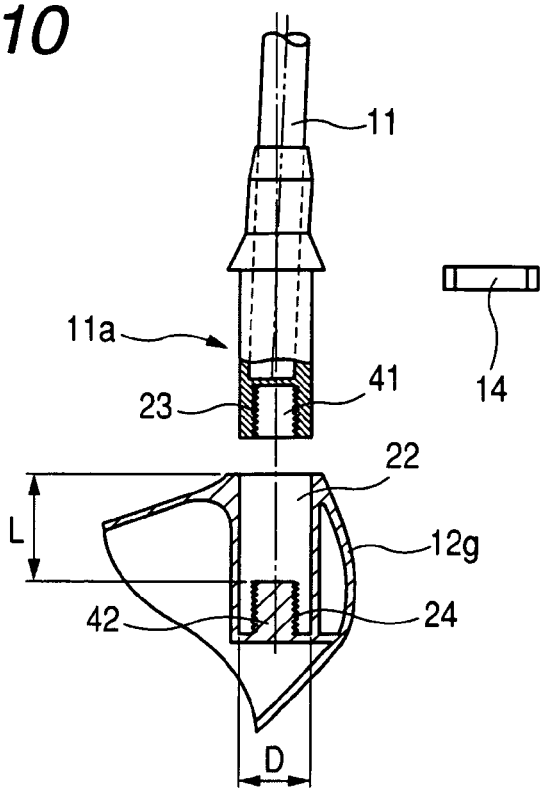
FIG. 10 is an exploded view describing a further example of how to connect a hosel portion a neck portion.

Alternatively, as is shown in FIG. 10, a configuration may be adopted in which an insertion hole 41 is formed in the insertion portion 28 of the neck portion 11*a*, an internal thread 23 is formed on an inner circumferential surface of the insertion hole 41, an insertion hole 22 having such a size that the insertion portion 28 can be inserted is formed in the hosel portion 12*g*, a projecting portion 42 is provided within the insertion hole 22, and an external thread 24 is formed on an outer circumferential surface of the projecting portion 42, whereby the neck portion 11*a* is inserted into the insertion hole 22 of the hosel portion 12*g*, so that the neck portion 11*a* and the hosel portion 12*g* are screwed together.

Of course, also in the configuration shown in FIG. 10, as with the first embodiment that has been described above, in such a state that the screwed engagement relationship between the screw portions 23, 24 is released, an insertion length of the neck portion at the distal end of the shaft (the insertion length of the portion where the screw portions 23, 24 are not formed) L is preferably set to be larger than a diameter D of an opening of the insertion hole 22. Further, in the configuration shown in FIG. 9, the external thread 24 may be formed at a proximal end of the projecting portion (the insertion portion) 42, and the length of a portion of the projecting portion where the external thread is not formed may be set larger than a diameter of the insertion hole 41.

According to this configuration, when the clubhead 12 is detached from the shaft 11, an erroneous fall of the clubhead can be prevented, thereby making it possible to prevent the clubhead being damaged or failed.

Fourth Embodiment

Figure 11:
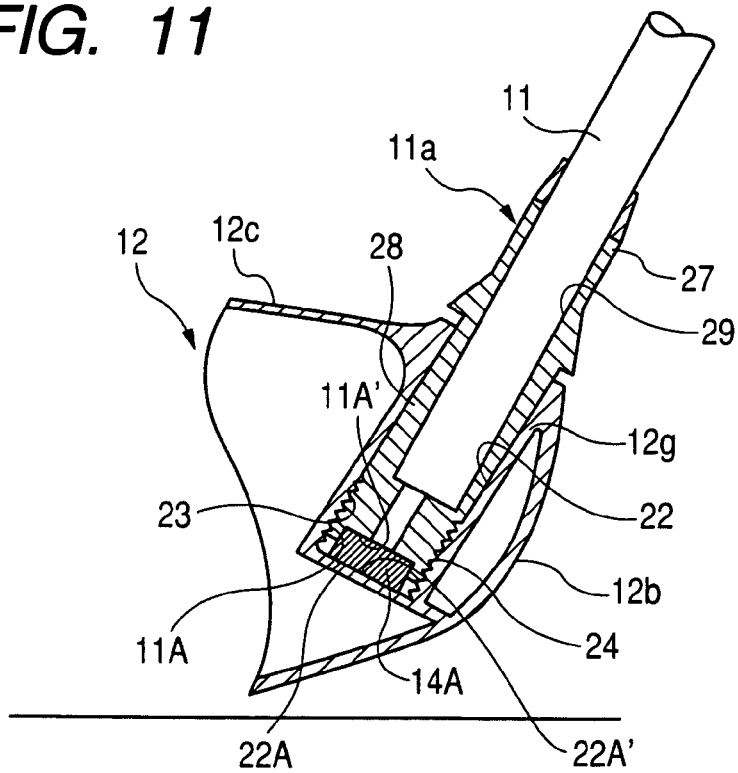
FIG. 11 is a drawing showing another embodiment of a disposing method of an adjuster element.

FIG. 11 is a drawing showing a disposing method according to a fourth embodiment of the adjuster element. As is shown in this embodiment, an adjuster element 14A is formed into a circular disc shape and is provided between a distal end of a neck portion 11*a* of a shaft and a bottom portion 22A of an insertion hole 22 formed in a hosel portion 12*g* in a replaceable fashion. In this case, an accommodating portion to or from which the adjuster element 14A can be attached or detached may only have to be formed at the distal end of the neck portion 11*a*, and an inner surface 22A' of the bottom portion 22A and an inner surface 1A' of the accommodating portion 11A constitutes support surfaces with which the adjuster element 14 is brought into abutment when an internal thread 23 and an external thread 24 are fastened together. In this way, the placing position of the adjuster element can be modified as required between the neck portion and the hosel portion.

Fifth Embodiment

Figure 12:
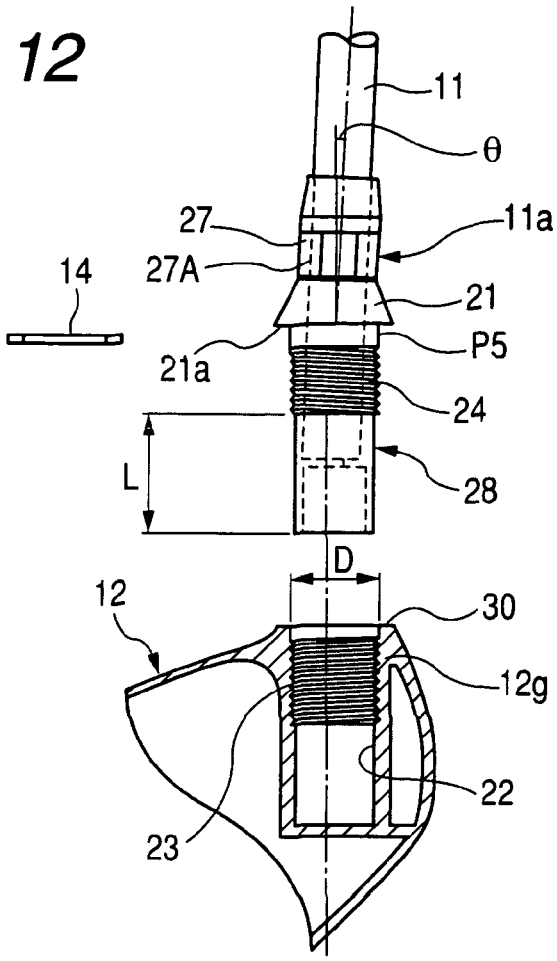
FIG. 12 is a drawing showing another embodiment of a neck portion and a hosel portion.

FIG. 12 is a drawing showing a neck portion and a hosel portion according to a fifth embodiment of the invention. In this embodiment, an engagement portion 27A with which a tool for use in attaching or detaching a shaft to or from a clubhead is brought into engagement is formed on a neck portion 11*a* of a shaft or, specifically, an outer circumferential area of an external extended portion 27. This engagement portion 27A is formed into a hexahedral portion so as to be operated to rotate by being gripped by a general spanner, and by adopting a configuration like this, when the clubhead is attached to or detached from the shaft, the attaching or detaching operation can be implemented with ease and in an ensured fashion. Further, the exertion of large torsional load on to a shaft main body can be prevented, thereby making it possible to provide the golf club which has superior strength and durability. Furthermore, making the tightening torque constant using a torque wrench as a tool or accurate adjustment of the relative positional relationship between the shaft and the rotating direction of the clubhead is facilitated, thereby making it possible to increase the accuracy of the set state.

Further, the engagement portion 27A may be formed into a polyhedral portion in which two opposing sides are formed or a quadrangular portion in addition to the hexahedral portion. Alternatively, in order to facilitate further the attaching or detaching operation, a configuration may be adopted in which many irregularities or ribs are formed on the outer circumferential surface of the external extended portion 27. Further, the engagement portion 27 is preferably formed in an area near to the screwed portion, whereby load generated at the time of attaching or detaching can be prevented from being exerted on the shaft main body. Further, a configuration may be adopted in which the engagement portion is provided on the hosel side.

Further, in the embodiment shown in FIG. 12, an outside diameter of a portion P5 where an adjuster element 14 is interposed between a first support surface 30 and a second support surface 21*a* when the clubhead 12 and the shaft 11 are screwed together is made larger than outside diameters of other portions (an outside diameter of a portion where an external thread 24 is formed). By adopting a configuration like this, the adjuster element 14 can easily be detached from the screw portion and can be attached stably, whereby looseness can be reduced in such a state that the adjuster element 14 is set in place. Further, not only can the adjuster element be used for a long period of time but also accurate comparison tests can easily be implemented.

Further, in the embodiment as is shown in FIG. 12, an external thread 24 is formed on a proximal end side of an insertion portion 28 of the neck portion 11*a*, while an internal thread 23 is formed on an opening side of an insertion hole 22. When adopting a configuration like this, since a portion of the insertion portion 28 of the neck portion 11*a* where the external thread 24 is formed is configured so as to be reinforced by the shaft on an inner side, the thickness of the portion in question can be reduced. Consequently, the neck portion 11*a* can be reduced in weight, thereby making it possible to increase the degree of freedom in designing the clubhead. Further, also in a configuration like this, a length L of a portion of the insertion portion 28 of the neck portion 11*a* where the external thread 24 is not formed is preferably formed larger than a diameter D of an opening in the insertion hole 22. By adopting this configuration, as with the embodiment that has been described before, an abrupt fall of the clubhead can be prevented when the clubhead 12 is attached or detached.

Of course, with respect to the relationship between L and D, as with the embodiment above, by setting the relationship such that L>1.2D or preferably L>1.5D, the fall of the clubhead can be prevented effectively.

Sixth Embodiment

Figure 13A:
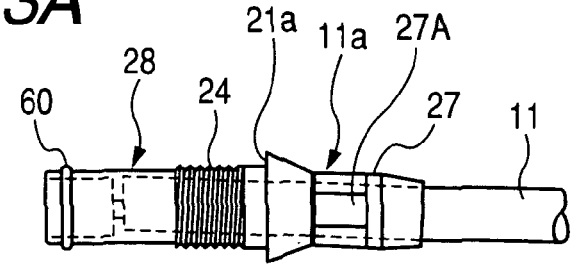
FIGS. 13A and 13B show a further embodiment of a neck portion.
Figure 13B:
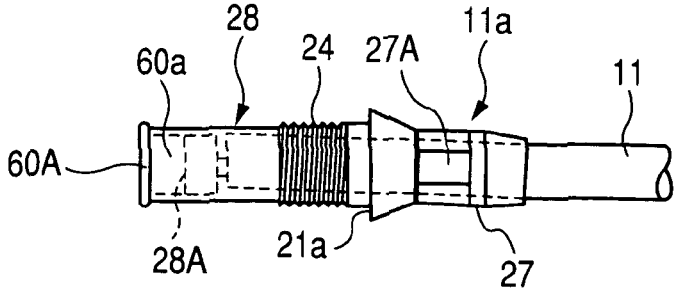

FIGS. 13A and 13B are drawings showing a neck portion according to a sixth embodiment of the invention. In this embodiment, a vibration absorbing member which is softer than a hosel portion and a neck portion is made to be interposed between an insertion hole 22 and an insertion portion 28 which are formed, respectively, in the hosel portion and the neck portion. Specifically, in a configuration shown in FIG. 13A, a circular groove is formed at a distal end side of the insertion portion 28 of the neck portion 11*a*, and a ring-shaped vibration absorbing member 60 made from a soft synthetic resin such as an elastomer resin is fitted in the circular groove so formed in such a manner that the insertion portion 28 can easily be inserted into or removed from the insertion hole 22. Further, in a configuration shown in FIG. 13B, a space portion 28A is formed at a distal end of an insertion portion 28, and a cylindrical vibration absorbing member 60A including a fitting portion 60*a* is press fitted in or fixed in place in the space portion 28A in such a manner that the insertion portion 28 can easily be inserted into or removed from the insertion hole 22.

By adopting a configuration like this, the vibration absorbing members 60, 60A can be interposed between the insertion hole 22 and the insertion portion in such a state that they are in contact with an inner surface of the insertion hole 22, thereby making it possible to prevent the generation of looseness of the clubhead and resulting noise.

In the vibration absorbing materials according to the configurations described above, metal may be made to be mixed into the soft synthetic resin to increase the damping properties or may be secured to the insertion portion with an adhesive or the like. Further, with respect to a method of providing the vibration absorbing members, the vibration absorbing members may be placed along the axial direction. Furthermore, the vibrating absorbing members can be placed on the hosel side (on the insertion hole side of the clubhead), and in this way, the method can be modified as required. Further, by changing the shapes and types of the vibration absorbing members, the sensation of striking a ball can be changed, thereby making it possible to provide more golf clubs.

Seventh Embodiment

Figure 14:
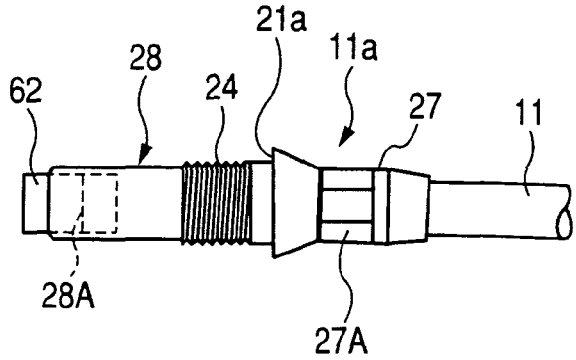
FIG. 14 is a drawing showing a further embodiment of a neck portion.

FIG. 14 is a drawing showing a neck portion according to a seventh embodiment of the invention. In this embodiment, a space portion 28A is formed at a distal end of a neck portion 11*a* (a distal end of an insertion portion 28) of a shaft, and a weight adjusting member 62 is held in this space portion 28A in a replaceable fashion. The weight adjusting member 62 can be held in the space portion 28A through press fitting or screwing, and in order to simplify attachment and detachment of the weight adjusting member 62, the weight adjusting member 62 can be formed by mixing or incorporating a material having a high specific weight (a specific weight of 5.0 or more) such as metal including tungsten, lead, copper and stainless steel or ceramics in rubber, elastomer resin or other soft resin. Alternatively, the aforesaid material having the high specific weight such as metal or ceramics may be used.

According to this configuration, a composite test which includes the weight adjustment by the weight adjusting member 62 in addition to lie angle and loft angle can be carried out, and various types of tests can be made simultaneously. In particular, a composite effect on the player by specification changes which has been unable to be evaluated through individual tests can be grasped correctly.

Further, the space portion for accommodating the weight adjusting member 62 may be formed not in the neck portion 11*a* but in the insertion hole 20 in the clubhead.

Eighth Embodiment

Hereinafter, an eighth embodiment of the invention will be described in detail by reference to the accompanying drawings. In the eighth embodiment of the invention, those portions similar in construction to the corresponding portions of the first embodiment will be designated by identical reference numerals, respectively, and explanation thereof will be omitted.

Figure 15:
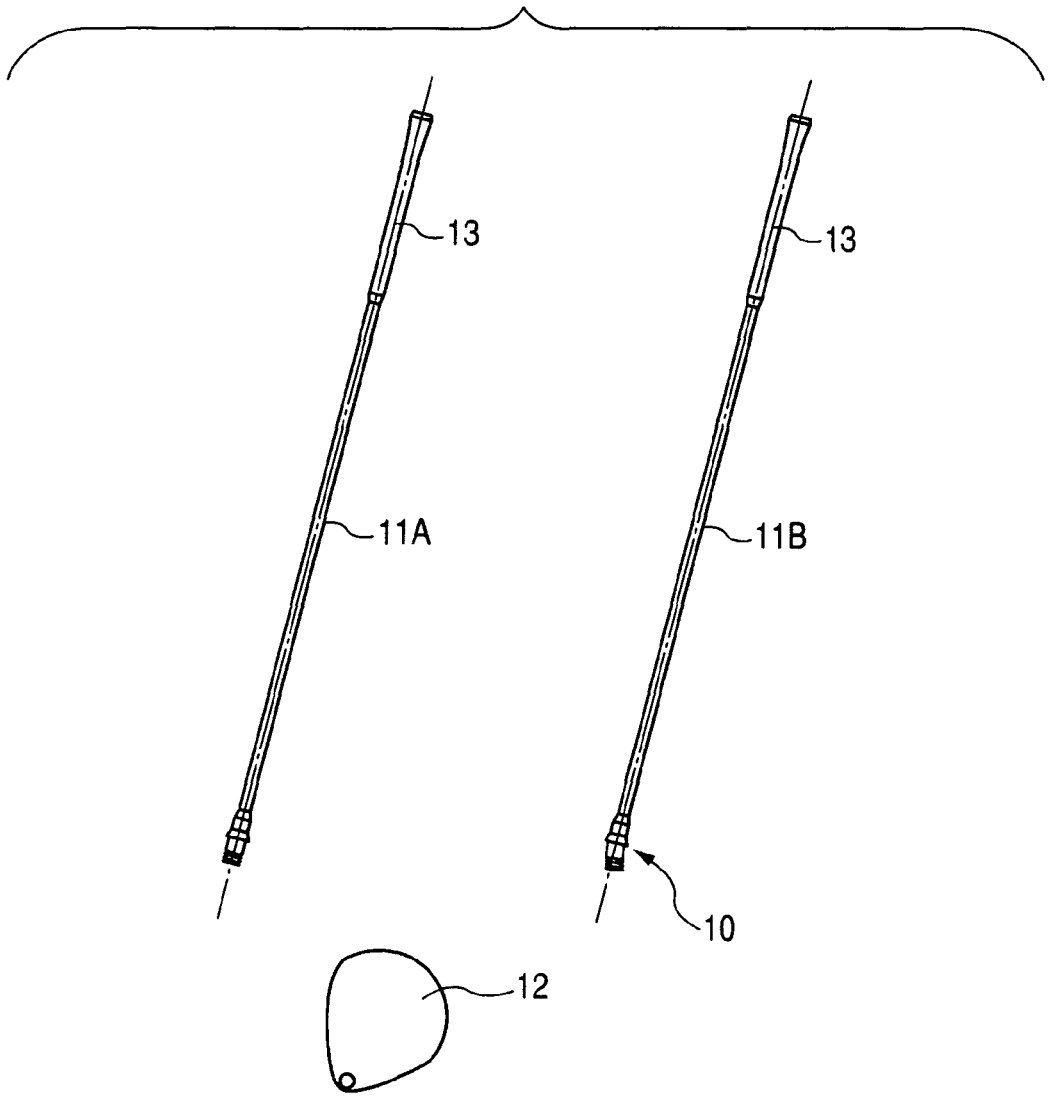
FIG. 15 is a drawing showing a basic configuration example of an attaching and detaching system of a clubhead and shafts of a golf club according to an eighth embodiment of the invention.

FIG. 15 is a drawing showing a basic configuration example of an attaching and detaching system of a clubhead and shafts of a golf club according to the eighth embodiment of the invention. This attaching and detaching system of a clubhead and a shaft is made up of, in order to make up a golf club, at least two shafts 11A, 11B and a at least one clubhead 12 which can be attached to and detached from the respective shafts 11A, 11B.

The two shafts 11A, 11B each have a neck portion, and a hosel portion of the clubhead 12 is made to be attached to and detached from the neck portion. Further, of the two shafts, the shaft 11A is configured as a "reference shaft" in which a center axis of a fitting portion in which the clubhead 12 is fitted for attachment and an axial center of the shaft are made to be oriented in the same direction, and the other shaft is configured as an "angled shaft" in which an angle (hereinafter, referred to as an "inclination angle") formed between a center axis of a fitting portion in which the clubhead 12 is fitted for attachment and an axial center of the shaft has a predetermined angle.

In the same manner as the first embodiment, the angle adjusting mechanism 10 which enables a selection of a position in a rotating direction relative to the center axis of the clubhead fitting portion (refer to FIG. 6) is installed between the angled shaft 11B and the clubhead 12 fitted therein. Further, as to the set of two shafts, the one shaft is made to have an inclination angle of 0 degree (the reference shaft) and the predetermined angle is set on the other shaft (the angled shaft), and these two shafts have the totally same conditions in terms of stiffness, balance, length and the like.

Further, the set of the club shafts and the clubhead which are to be combined together shown in FIG. 15 shows a minimum unit of the attaching and detaching system of a clubhead and shafts, and in addition to the combination shown in the figure, different club heads (a plurality of clubheads may be provided) having different loft angles, lie angles and face angles may be prepared. Further, as to the shafts, further sets of two shafts as a unit may be prepared which are different in stiffness, length and balance from the shafts 11A, 11B. Furthermore, as to the shafts to be combined as a set, a single reference shaft may only be included, and in addition to the single reference shaft, two or more shafts having different inclination angles may be prepared. In ether of the cases, golf clubs of far more types and specifications can be provided for the number of clubheads and shafts so prepared.

In such a state that the clubhead 12 is attached to the shaft 11B in the same manner as the first embodiment as shown in Fig. FIG. 3, the shaft 11B is configured such that a center axis of the fitting portion on which the clubhead is fitted, specifically, in the configuration of this embodiment, a center axis 26 of the insertion hole 22 of the portion where the internal thread 23 is formed and a center axis 11*c* of the shaft 11B are configured so as to be inclined at a predetermined angle θ therebetween (the shaft 11B is configured as the "angled shaft" described above).

In this case, this angle θ is preferably set in the range of 0.5 degree to 5 degrees in consideration of a changing range of the lie angle and the loft angle. However, the angle θ is not limited to this range and can be set to a value which falls out of the range as required. Note that a shaft in which this angle θ is set to 0 degree constitutes the reference shaft 11A.

According to the eighth embodiment, test striking is enabled by changing the lie angle, loft angle and face angle only by changing simply the adjuster element 14 relative to the single clubhead without preparing a number of types clubheads, and a golf club with desired lie angle, loft angle and face angle can be provided to a customer while making a comparison study with the reference shaft 11A based on the results of the test striking.

TABLE 2

Example of Adjustment by Adjuster Elements (using the eight-equal-dividing method) according to the eighth embodiment

| No. | Rotating angles (compared to reference position) | Increase in thickness (compared to reference position) | Examples (unit mm) | | | Inclination θ (example of 2 degrees) | | |
|---|---|---|---|---|---|---|---|---|
| | | | Example of FIG. 8A | Example of FIG. 8B | Example of FIG. 8C | lie angle | loft angle | face angle |
| 1 | 0 degree (reference position) | 0 (reference thickness) | (5 mm) reference | (5 mm) reference | with no adjuster element | 60.0° | 10.0° | 0 |
| 2 | 45 degrees | +1/8XP | 0.1875 | 5.1875 | 3 mm reference plus two pitches | 59.4° | 8.6° | 1.8° |
| 3 | 90 degrees | +2/8XP | 0.375 | 5.375 | 3.375 | 58.0° | 8.0° | 2.6° |
| 4 | 135 degrees | +3/8XP | 0.25625 | 5.5625 | 3.5625 | 56.6° | 8.6° | 1.8° |
| 5 | 180 degrees | +4/8XP | 0.75 | 5.75 | 3.75 | 56.0° | 10.0° | 0° |
| 6 | 225 degrees | +5/8XP | 0.9375 | 5.9375 | 3.9375 | 56.6° | 11.4° | −1.8° |
| 7 | 270 degrees | +6/8XP | 1.125 | 6.125 | 4.125 | 58.0° | 12.0° | −2.6° |
| 8 | 315 degrees | +7/8XP | 1.13125 | 6.3125 | 4.3125 | 59.4° | 11.4° | −1.8° |
| 9 | | | | | | 58.0° | 10.0° | 0° |

Note 1)

P: length of one pitch of thread (in the examples above, one pitch is 1.5 mm)

Note 2)

lie angle, loft angle and face angle are those when the inclination angle is 2 degrees. Numeric values other than those shown above may be selected for thread pitch and shaft inclination angle. Other divisions than the eight equal division may be arbitrarily used including four equal division, six equal division and the like.

Note 3)

face angle is an angle formed by the face surface relative to a direction which intersects the center axis of the shaft at right angles. Slice face is indicated by + sign, while hook face is indicated by − sign.

Note 4)

No. 9 shows states resulting when the clubhead is attached to the reference shaft.

The above Table 2 shows the example of the attaching and detaching system of a clubhead and shafts according to the eighth embodiment. As shown under No. 9, in the golf club (the reference club constituting a comparison object) in which the clubhead 12 is attached to the reference shaft 11A shown in FIG. 1, it is set such that the lie angle becomes 58.0 degrees, the loft angle 10.0 degrees and the face angle 0 degree. Further, when attaching the clubhead 12 as it is from the reference shaft 11A to the angled shaft 11B described above, the lie angle, loft angle and face angle can be changed to numeric values shown in Table 2 by interposing adjuster elements 14 shown under No. 1 to No. 8 (which are configured as is shown in the following FIG. 8A, or FIG. 8B or FIG. 8C).

Because of this, the tester (the customer) can accurately compare the golf club which was changed with respect to lie angle, loft angle and face angle by attaching the configuration of the clubhead 12 used in the test striking carried out using the golf club based on the reference shaft 11A to the angled shaft 11B without changing the state (with the clubhead weight and clubhead balance staying under the same conditions) with the golf club constituting the reference so as to make a judgment on the specification of the clubhead of a golf club which is more suitable for him or her. By this, a combination suitable for the customer can easily be selected, thereby making it possible to enhance the degree of satisfaction of the customer.

By using the adjuster element set described above in connection with FIGS. 8A to 8C, the reference position and the specification can be confirmed correctly, and a matching relationship between a change in lie angle or loft angle from the reference and the swing of a customer who carried out a test striking can easily be recognized.

Although in the attaching and detaching system of a clubhead and shafts of a golf club that has been described heretofore, the reference shaft 11A and the angled shaft 11B and the single clubhead 12 are made to constitute a minimum unit set, a plurality of clubheads having different specifications may, of course, be prepared. For example, another clubhead in which the loft angle is set to 12° is prepared, and when this clubhead is attached to the reference shaft 11A or the angle shaft 11B, test striking can be carried out with respect to a golf club that is specified in Table 3 below.

TABLE 3

Example of Adjustment by Adjuster Elements (using the eight-equal-dividing method) according to the eighth embodiment

| No. | Rotating angles (compared to reference position) | Increase in thickness (compared to reference position) | Examples (unit mm) | | | Inclination θ (example of 2 degrees) | | |
|---|---|---|---|---|---|---|---|---|
| | | | Example of FIG. 8A | Example of FIG. 8B | Example of FIG. 8C | lie angle | loft angle | face angle |
| 1 | 0 degree (reference position) | 0 (reference thickness) | (5 mm) reference | (5 mm) reference | with no adjuster element | 60.0° | 12.0° | 0 |

TABLE 3-continued

| Example of Adjustment by Adjuster Elements (using the eight-equal-dividing method) according to the eighth embodiment | | | | | | | | |
|---|---|---|---|---|---|---|---|---|
| | Rotating angles (compared to | Increase in thickness (compared to | Examples (unit mm) | | | Inclination θ (example of 2 degrees) | | |
| No. | reference position) | reference position) | Example of FIG. 8A | Example of FIG. 8B | Example of FIG. 8C | lie angle | loft angle | face angle |
| 2 | 45 degrees | +1/8XP | 0.1875 | 5.1875 | 3 mm reference plus two pitches | 59.4° | 10.6° | 1.8° |
| 3 | 90 degrees | +2/8XP | 0.375 | 5.375 | 3.375 | 58.0° | 10.0° | 2.6° |
| 4 | 135 degrees | +3/8XP | 0.25625 | 5.5625 | 3.5625 | 56.6° | 10.6° | 1.8° |
| 5 | 180 degrees | +4/8XP | 0.75 | 5.75 | 3.75 | 56.0° | 12.0° | 0° |
| 6 | 225 degrees | +5/8XP | 0.9375 | 5.9375 | 3.9375 | 56.6° | 13.4° | −1.8° |
| 7 | 270 degrees | +6/8XP | 1.125 | 6.125 | 4.125 | 58.0° | 14.0° | −2.6° |
| 8 | 315 degrees | +7/8XP | 1.13125 | 6.3125 | 4.3125 | 59.4° | 13.4° | −1.8° |
| 9 | | | | | | 58.0° | 12.0° | 0° |

Note 1)

P: length of one pitch of thread (in the examples above, one pitch is 1.5 mm)

Note 2)

lie angle, loft angle and face angle are those when the inclination angle is 2 degrees. Numeric values other than those shown above may be selected for thread pitch and shaft inclination angle. Other divisions than the eight equal division may be arbitrarily used including four equal division, six equal division and the like.

Note 3)

face angle is an angle formed by the face surface relative to a direction which intersects the center axis of the shaft at right angles. Slice face is indicated by + sign, while hook face is indicated by − sign.

Note 4)

No. 9 shows states resulting when the clubhead is attached to the reference shaft.

Namely, as is shown in Table 2 and Table 3, only by preparing the two shafts (the reference shaft 11A, the angled shaft 11B) and the two clubheads having the different configurations, 18 tests in total can be implemented.

Furthermore, by preparing the shafts of different specifications, a remarkably large number of types of tests can be carried out. For example, by preparing a plurality of sets of shafts having different specifications (with respect to stiffness and balance) as the set of shafts, a larger number of tests can be carried out with fewer configurations. Specifically, for example, by preparing four clubheads which are different in loft angle and four sets of shafts which are different in stiffness and balance as the shaft set (since each set is made up of a reference shaft and an angle shaft, eight shafts result in total), tests can be carried out in 144 ways in total.

Thus, while the embodiments of the invention has been described heretofore, apart from the embodiments that have been described above, the invention can be modified as required without departing from the spirit and scope thereof. For example, the features shown in FIGS. 11 to 14 may be applied to the configurations shown in FIGS. 1 to 10, and the features of the eighth embodiment can be combined with the second to the seventh embodiments other than the first embodiment.

Ninth Embodiment

Figure 16A:
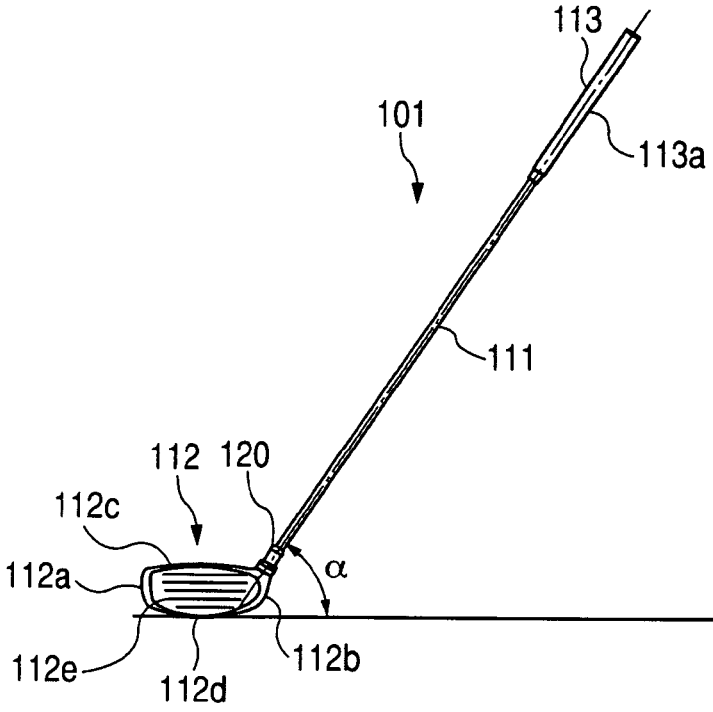
FIG. 16A is a drawing showing an embodiment of a golf club according to a ninth embodiment of the invention with a face portion oriented to the front.
Figure 16B:
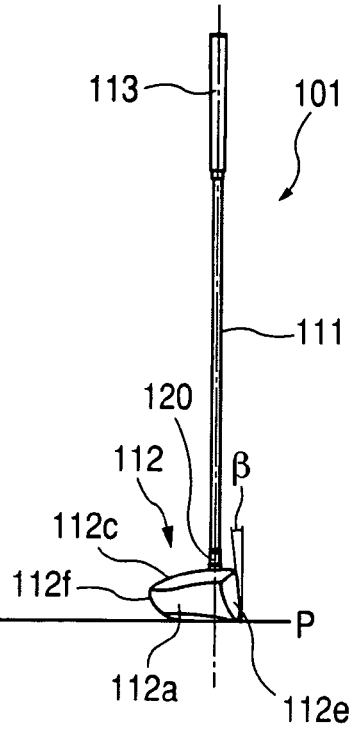
FIG. 16B is a drawing with a toe portion oriented to the front.
Figure 17:
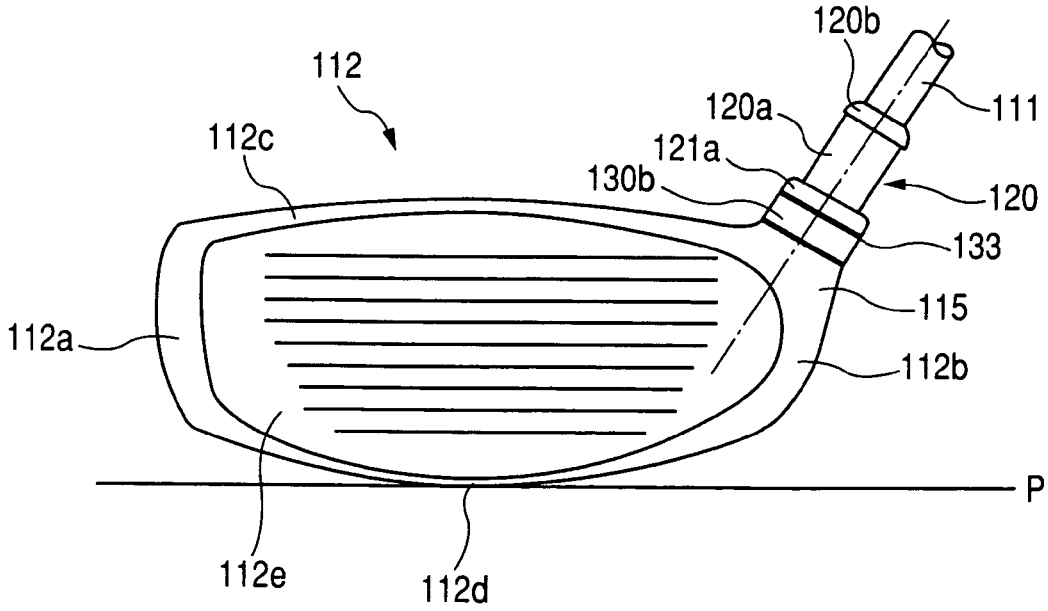
FIG. 17 is a front view of a clubhead of the golf club shown in FIG. 16A.
Figure 18:
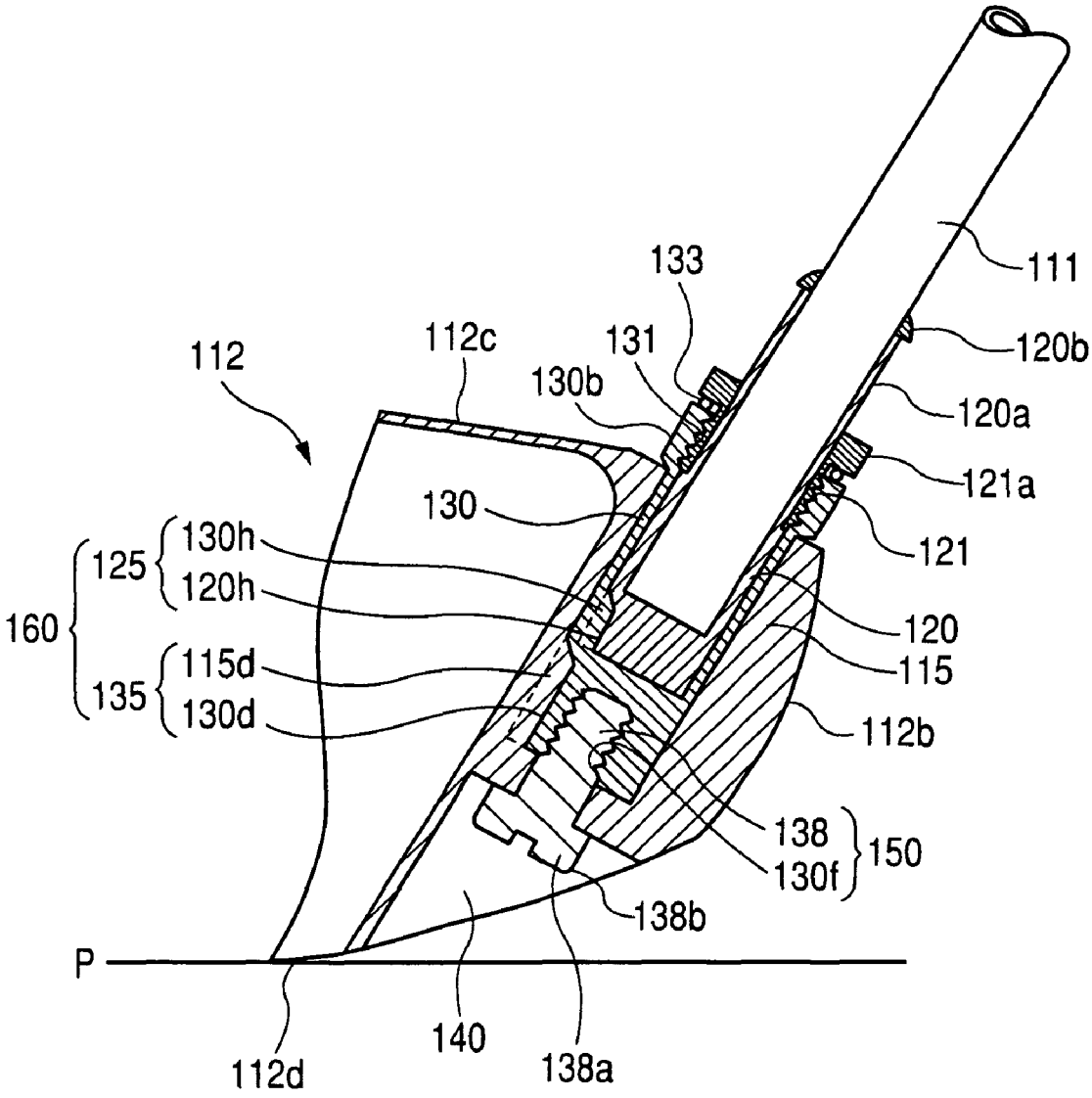
FIG. 18 is an enlarged sectional view of a hosel portion of the clubhead of the golf club shown in FIG. 16A.
Figure 19:
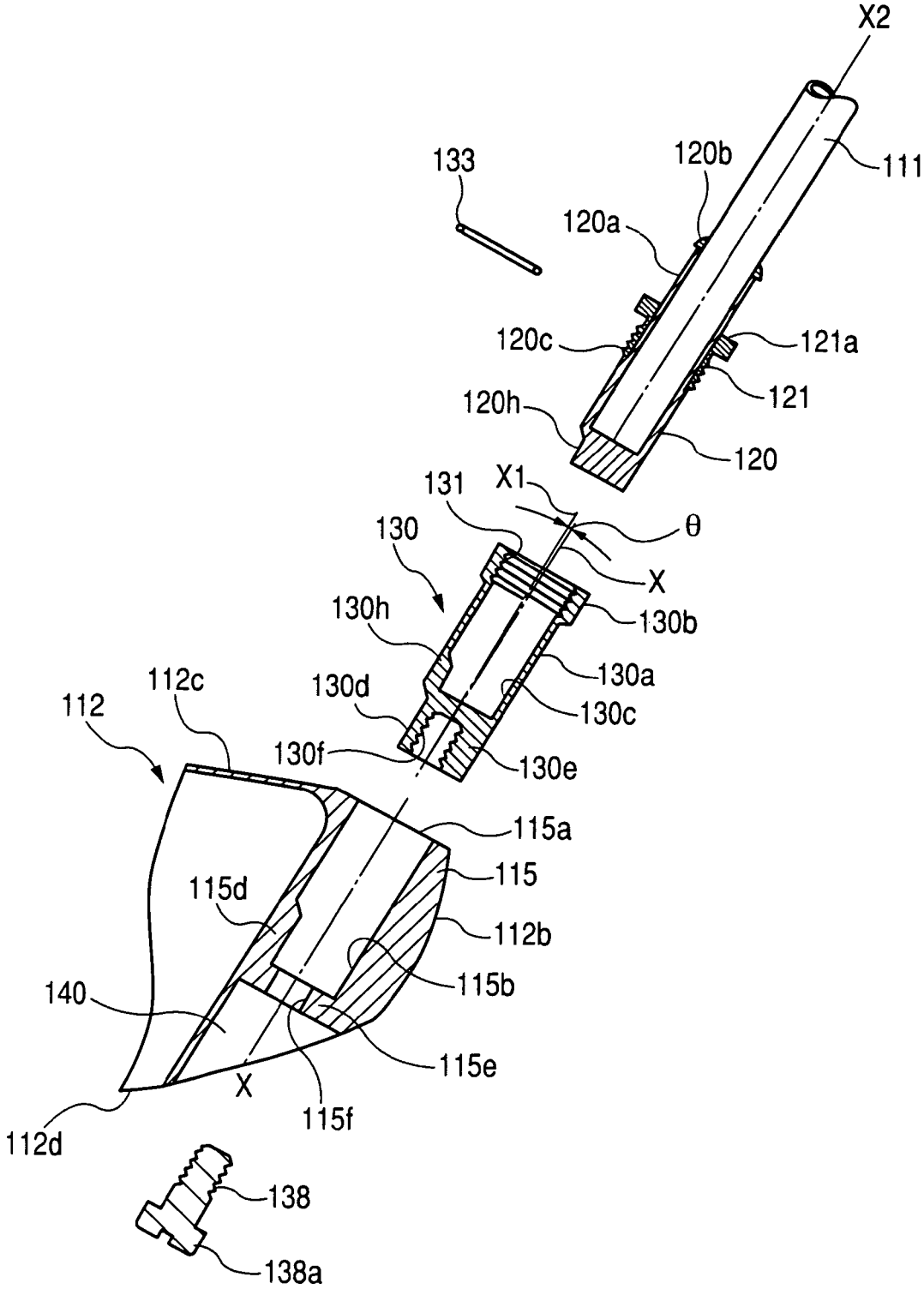
FIG. 19 is an exploded view of a connecting portion between the clubhead and a shaft of the golf club shown in FIG. 16A.

FIGS. 16A to 19 are drawing showing a ninth embodiment of a golf club according to the invention, of which FIG. 16A is a drawing of a golf club with a face portion oriented to the front, FIG. 16B is a drawing of the golf club with a toe portion oriented to the front, FIG. 17 is a front view of a clubhead, FIG. 18 is an enlarged sectional view of a hosel portion of the clubhead, and FIG. 19 is an exploded view of a connecting portion between the clubhead and a shaft.

A golf club 101 shown in FIGS. 16A, 16B is made up by tying up a clubhead 112 to a distal end portion of a shaft 111 which is made of metal or FRP, the clubhead 112 being set to a predetermined lie angle α and a predetermined loft angle β relative to a reference horizontal plane (the ground surface) P. Note that when used herein, the "loft angle" is such as to be called a so-called "real loft" and specifically, a loft angle which results when the clubhead 112 is set to the predetermined lie angle α with a face angle being set to 0°. A neck portion 120 is provided at a distal end of the shaft 111, and the clubhead 112 is made to be attached to the neck portion 120 via an angle adjuster element 130. Normally, the shaft 111 and the neck portion 120 are joined together with an adhesive.

In this case, the neck portion 120 is formed into a separate element from the shaft 111, but the neck portion 120 may be formed integrally with the shaft. When the neck portion 120 is formed integrally with the shaft, the neck portion 120 may be formed directly on the shaft 111 or the neck portion 120 may be formed integrally with the shaft through insert molding.

In addition, a grip 113 made of a soft flexible material such as a natural rubber or a synthetic rubber is attached to a proximal end of the shaft 111. A back seam 113*a* is provided on the grip 113 in such a manner as to extend along an axial direction on a lower side thereof when the golfer takes an address position with the golf club gripped properly by him or her. Normally, the back seam 113*a* is swollen along the axial direction of the grip 113, and the grip 113 is tied up to the shaft 111 in such a manner that the seam line 113*a* is positioned on the lower side of the grip 113 in consideration of the properties of the shaft 111 (swing balance, deflecting direction and the like).

In addition, the grip 113 may be formed into a true circle in which the thickness and an external shape remain the same in any position thereon so that the same gripping feeling can be obtained in any position through 360° when the shaft 111 is rotated (the truce circle here only has to be to such accuracy as to provide a grip state in which a feeling of physical disorder is made difficult to be felt by the golfer when the shaft or grip is gripped by the golfer, and a grip like this is generally referred to as a "grip with no back seam"). In addition, the hardness of the grip is also made uniform along a circumferential direction thereof, whereby the same gripping feeling can be made to be obtained in any position when the shaft 111 is rotated.

The clubhead 112 has a toe portion 112*a*, a heel portion 112*b*, a crown portion 112*c*, and a sole portion 112*d*. In addition, a face portion 112*e* for striking a ball is provided in such a manner as to be positioned at a front surface side of each of these constituent elements of the clubhead 112, and a back portion 112*f* is provided on an opposite side of the clubhead 112 to the face portion 112*e*. In this case, apart from a face material which is tied up to the face portion 112*e*, the clubhead 112 is preferably formed integrally through casting by the use of, for example, a titanium alloy (Ti-6Al-4V, Ti-15V-3Cr-3Sn-3Al), or Custum450 (made by Carpenter Inc.). Additionally, an opening is formed on a front surface side of the clubhead 112 in such a manner that the face material which makes up a ball striking surface of the face portion 112*e* is securely fitted therein. In addition, the clubhead 112 may be formed by preparing the respective constituent components thereof in advance and welding or bonding them together afterwards.

As the face material that is tied up to the face portion 112*e*, for example, a titanium alloy (Ti-15V-3Cr-3Sn-3Al, Ti-6Al-4V, SP700, Ti-15V-6Cr-4Al, Ti-15Mo-5Zr-3Al), an iron-based alloy (Custum450, 465 (made by Carpenter Inc.), 18Ni-12Co-4.5Mo-1.5Ti—Fe) or Ti-30Nb-10Ta-5Zr is preferably formed integrally through pressing into a predetermined plate shape. The face material so formed is then fitted in the opening formed in the face portion 112*e* and is tied up in place therein through bonding, welding or brazing. Note that the face portion 112*e* may be formed integrally with the clubhead 112 rather than being fitted with the face material which constitutes a separate member or the whole face portion 112*e* may be configured as a separate face member from the clubhead 112.

A hosel portion 115 is provided in an interior of the clubhead 112, and the shaft 111 is attached to the hosel portion 115 so provided. The hosel portion 115 has an opening 115*a* which is formed at a heel side on a face side of the crown portion 112*c* and a bottomed fitting hole 115*b* which has a circular cross section and extends towards the sole side from the opening 115*a*. The neck portion 120 of the shaft 111 is inserted into the fitting hole 115*b* to be fixed in place therein via the angle adjuster element 130 which is formed substantially into a cylindrical shape. This angle adjuster element 130 is a member which can be detached from the neck portion 120 of the shaft 111 and the hosel portion 115 of the clubhead 112 (a replaceable member) and is made to be fitted in the fitting hole 115*b* of the hosel portion 115 in such a state that the angle adjuster element 130 is attached to the distal end of the shaft 111 or as a single element. A material having high strength and low specific weight is preferable as a material for the neck portion 120 and the angle adjuster element 130, and for example, a titanium-based alloy (Ti-6Al-4V, Ti-15V-3Cr-3Sn-3Al, pure titanium) is preferably preferable, and an iron-based alloy (SUS630, SUS341) may also be used. In addition, the hosel portion 115, the angle adjuster element 130 and the neck portion 120 are preferably made of a metal of the same system in order to prevent electric corrosion (for example, in the case of a clubhead main body being made of a titanium alloy, the hosel portion 115 is formed integrally with the main body, and the angle adjuster element 130 and the neck portion 120 are prepared a titanium-based alloy (for example, Ti-15V-3Cr-3Sn-3Al)). In this case, in the event that a metal of the same base cannot be used, the surfaces of the respective constituent parts may be coated to prevent electric corrosion.

The angle adjuster element 130 includes a cylindrical portion 130*a* that is fitted in the fitting hole 115*b* and a large-diameter portion 130*b* which has a larger diameter than the cylindrical portion 130*a*. In addition, the cylindrical portion 130*a* of the angle adjuster element 130 has an external shape which enables an angle setting (to an angle referred to as an adjustment angle θ) between an axis X of the hosel portion 115 and an axis X1 of the cylindrical portion when the cylindrical portion 130*a* is fitted in the fitting hole 115*b* from the opening 115*a*.

In this case, a fittingly attaching hole 130*c* is formed within the cylindrical portion 130*a* of the angle adjuster element 130, and the neck portion 120 of the shaft 111 is inserted into the fittingly attaching hole 130*c* so formed. The fitting attaching hole 130*c* is formed in such a manner that when the neck portion 120 of the shaft 111 is inserted into the fittingly attaching hole 130*c*, an axis X2 of the shaft 111 coincides with the axis X1 of the angle adjuster element 130 (the cylindrical portion 130*a*). Namely, as will be described later, by an external thread 121 provided on the neck portion 120 being screwed on to an internal thread 131 formed on an inner circumferential surface of the large-diameter portion, the shaft 111 and the angle adjuster element 130 are made to be fittingly attached in a detachable fashion to each other in such a manner that the axis X2 of the shaft 111 coincides with the axis X1 of the angle adjuster element 130.

By this configuration, when the shaft 111 is attached to the hosel portion 115 via the angle adjuster element 130, the aforesaid adjustment angle θ is produced between the axis X2 of the shaft 111 and the axis X of the hosel portion 115.

Consequently, due to the external shape of the angle adjuster element 130, specifically, due to the shape of the cylindrical portion 130*a* of the angle adjuster element 130, the angle formed between the axis X2 of the shaft 111 and the axis X of the hosel portion 115 can be changed. Namely, the angle adjuster element 130 has a function of a replaceable member to adjust the axis X2 of the shaft 111 which is attached to the clubhead 112 to a different angle relative to the hosel portion 115 of the clubhead 112.

The hosel portion 115 and the angle adjuster element 130 are fittingly attached to each other in such a state that relative rotation is prevented by a rotation preventive mechanism which will be described below. A rotation preventive mechanism 135 according to the embodiment is made up of a cutout portion 130*d* which is formed on an outer surface of the cylindrical portion 130*a* of the angle adjuster element 130 and a projecting portion 115*d* which is formed on an inner surface of the fitting hole 115*b* of the hosel portion 115 and which has a shape which matches that of the cutout portion 130*d*.

Figure 20A:
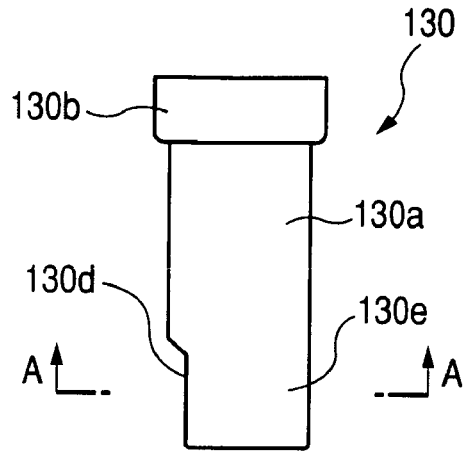
FIG. 20A is a side view showing an angle adjuster element.
Figure 20B:
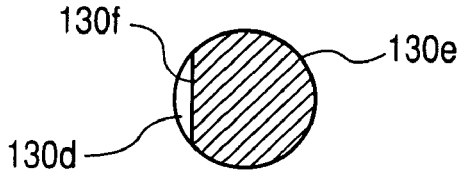
FIG. 20B is a sectional view taken along the line A-A in FIG. 20A.

The projecting portion 115*d* and the cutout portion 130*d* may only have to have a shape which can preventive rotation thereof, and for example, as is shown in FIGS. 20A and 20B, the cutout portion 130*d* can be made into a slot-like portion which is formed by forming a solid portion 130*e* at a lower portion of the cylindrical portion 130*a* and cutting out a circumferential part of the solid portion 130*e* along a diametrical direction.

In addition, the cutout portion 130*d* having the slot-like construction described above preferably includes a play and looseness preventive mechanism. The play and looseness preventive mechanism can be made by, for example, forming a surface of the cutout portion 130*d* into a tapered shape which is gradually reduced in diameter as it extends downwards.

By the rotation preventive mechanism 135 provided with the play and looseness preventive mechanism, the fittingly attaching and detaching operations of the hosel portion 115 and the angle adjuster element 130 are facilitated, and when both the members are fittingly attached to each other, rotation between both the members is prevented, whereby the fittingly attached state free from play and looseness is obtained therebetween.

Figure 21:
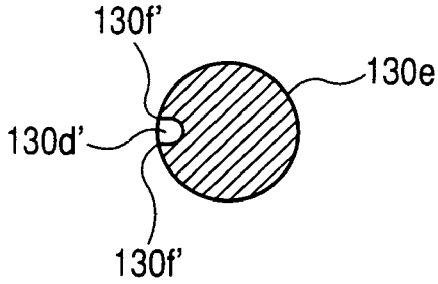
FIG. 21 is a sectional view showing a modified embodiment of an angle adjuster element.

The rotation preventive mechanism 135 can be modified as required. For example, the slit-like portion (the cutout portion 130*d*) may be formed on both sides of the circumferential surface of the solid portion 130*e* or a recessed groove may be formed in a center of the solid portion 130*e* in such a manner as to extend in the axial direction. Alternatively, an indented shape or polygonal shape may be formed on the outer circumferential surface of the angle adjuster element 130, or as is shown in a sectional view of FIG. 21, a recessed groove 130*d*' may be formed on a circumferential part of a solid portion 130*e* in such a manner as to extend in the axial direction. Further, a recessed groove may be formed on both the inner surface of the fitting hole 115*b* and the outer surface of the angle adjuster element 130 to form a key groove, so that a key is inserted into the key groove so formed to prevent rotation.

In addition, a play and looseness preventive mechanism like the one described above is preferably provided on the rotation preventive mechanism so configured.

Here, the play and looseness preventive mechanism will be described.

As has been described above, although the play and looseness preventive mechanism can be made up by making the surface of the cutout portion 130*d* into a tapered shape which gradually decreases in diameter as it extends downwards (in FIG. 20B, a surface on which such tapering is formed is denoted by reference numeral 130*t*, and a surface in a diametrical direction is reduced in diameter), such tapering may be formed on a circumferential surface thereof. Specifically, in the configuration shown in FIG. 21, also in the event that a surface 130*t*' (a circumferential surface) which defines the recessed groove 130*d*' formed in the solid portion 130*e* is formed in to a tapered shape, play and looseness can be prevented between the hosel portion 115 and the angle adjuster element 130.

In this case, although the tapering is preferably formed on both the diametrical surface 130*t* and the circumferential surface 130*t*', in the event that the tapering is formed on one of the two surfaces, precedence or importance be preferably placed on the circumferential surface 130*t*'. In addition, in the event that the tapering is formed long in a direction in which the members are attached to each other in an inserting fashion and detached from each other (or a moderate tapering is formed), both the members tend to stick to each other, and therefore, a play and looseness mechanism may be made up by forming a large tapered portion at a distal or proximal portion of the rotation preventive mechanism.

Alternatively, the play and looseness preventive mechanism may be configured so as to obtain a pressurized fitting relationship between the member, that is, the cutout portion 130*d* of the cylindrical portion 130*a* of the angle adjuster element 130 and the member, that is, the projecting portion 115*d* on the fitting hole 115*b* of the hosel portion 115 by diametrically increasing (the internally placed member) or decreasing (the externally placed member) at least part of the portion where the members are fitted in or on each other rather than forming the fitting portion into the tapered shape. For example, as will be described below, in a configuration shown in FIG. 19, when forming an internal thread portion 130*f* on a lower surface of the solid portion 130*e* of the angle adjuster element 130, a slit groove is formed in the portion where the internal thread portion 130*f* is formed in advance, and by an externally threaded screw 138 which has a larger diameter than that of the internal thread portion 130*f* being screwed in the internal thread portion 130*f*, the diametrical surface of the cutout portion 130*d* of the angle adjuster element 130 can be increased in diameter. Namely, by the externally threaded screw 138 being screwed in the internal thread portion 130*f*, the portion where the externally threaded screw 138 is so screwed in is gradually increased in diameter, so as to prevent completely play and looseness.

Note that the play and looseness preventive mechanism that has been described above may be provided at the portion where a rotation preventive mechanism 125, which will be described later, is provided between the angle adjuster element 130 and the neck portion 120, in addition to the portion where the rotation preventive mechanism 135 is provided between the hosel portion 115 and the angle adjuster element 130. In addition, in the configuration described above in which the recessed grooves are formed on both the inner surface of the fitting hole 115*b* and the outer surface of the angle adjuster element 130 so as to constitute the key groove so that the key is inserted into the key groove for prevention of rotation, the play and looseness preventive mechanism may only have to be provided in this portion.

In addition, the angle adjuster element 130 described above is made to be fittingly attached to the clubhead 112 in a detachable fashion (in such a manner as to be detached freely). In this embodiment, the internal thread portion 130*f* is formed on the lower surface of the solid portion 130*e* of the angle adjuster element 130 in advance, and the external thread portion 138 is screwed in the internal thread portion 131*f* so formed from the sole side of the clubhead 112 via a penetrating hole 115*f* formed in a bottom portion 115*e* of the hosel portion 115, whereby the angle adjuster element 130 can be fittingly attached to the clubhead 112 in the detachable fashion.

Namely, a dislocation preventive mechanism 115 for preventing the dislocation of the hosel portion 115 and the neck portion 120 from each other is provided on the hosel portion 115 and the neck portion 120 in such a state that the angle adjuster element 130 is interposed therebetween, and this dislocation preventive mechanism 150 is made up of the internal thread portion 130*f* formed in the angle adjuster element 130 and the externally threaded screw 138 which is screwed into the internal thread portion 130*f* from the sole side of the clubhead 112.

In this embodiment, a recessed portion 140 is formed in a transition area from the sole portion 112*d* to the heel portion 112*b* of the subhead 112 in such a manner as to be associated with the hosel portion 115 so that the dislocation preventive mechanism 150 can be installed, and by the externally threaded screw 138 being screwed in and out from the portion where the recessed portion 140 is formed, the detachable attachment of the angle adjuster element 130 and the occurrence of dislocation between the hosel portion 115 and the neck portion 120 are implemented. In this case, as an actual detachable attachment method, a groove (a + shaped or − shaped groove) may be formed in a head portion 138*a* of the externally threaded screw 138 and a general screw driver may be used for detachable attachment. Alternatively, the head portion 138*a* of the externally threaded screw 138 is preferably formed into a hexagonal or quadrangular shape, so as to increase the fixing force and be durable against repeated use.

Figure 25:
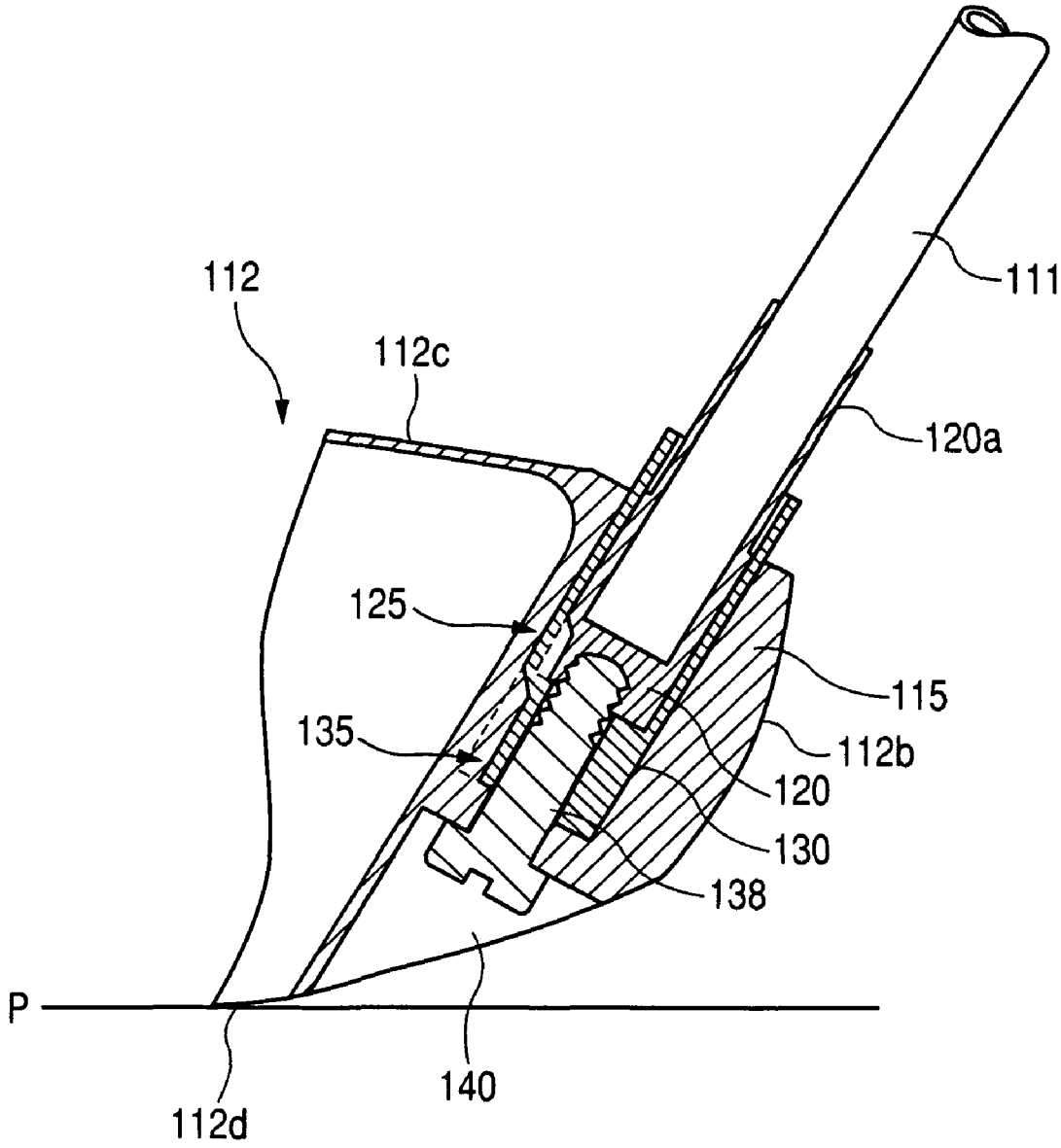
FIG. 25 is a drawing showing a further embodiment of a golf club according to the invention (a modified example to the configuration shown in FIG. 18).

As is shown in FIG. 25, the dislocation preventive mechanism 150 can also be made to fix the hosel portion 115, the angle adjuster element 130 and the neck portion 120 altogether at the same time. By this configuration, the external thread portion 121 for fixing the neck portion 120 to the angle adjuster element 130 and the large-diameter portion 130*b*

(including the internal thread 131) of the angle adjuster element 130 which are shown in FIG. 18 can be made unnecessary, so as to reduce the weight of the whole golf club, whereby the degree of freedom in mass distribution design such as the inertia moment of the golf club is increased, and the degree of freedom in design of the neck portion is also increased. Further, the angle adjusting time can also be shortened.

In addition, as is shown in FIG. 18, the position of the externally threaded screw 138 is preferably determined in such a manner that an interval between a lowermost end 138*b* of the externally threaded screw 138 and the ground surface P has a predetermined distance (3 mm or larger, and preferably, 5 mm or larger) when the clubhead 112 is set to the predetermined lie angle. Additionally, a member such as a washer is preferably provided between the externally threaded screw 138 and the hosel portion 115 for preventing the occurrence of looseness therebetween.

The neck portion 120 is provided at the distal end of the shaft 111 in such a manner as to be placed to cover an outer circumference of the distal end of the shaft 111. This neck portion 120 has a reinforcement tube 120*a* which is formed integrally on an upper side thereof, and a radially projecting ring (stopper) 120*b* is formed at an upper end of the reinforcement tube 120*a*. In addition, the thread portion (the external thread) 121 is provided on the reinforcement tube 120*a* in such a manner as to rotate relative to the shaft portion 111 and the neck portion 120, as well as slide along an axial direction thereof.

By the neck portion 120 being inserted into the fittingly attaching hole 130*c* in the angle adjuster element 130 and screwed in the internal thread 131 formed in the large-diameter portion 130*b* of the angle adjuster 130, the thread portion 121 functions to fix the shaft 111 (the neck portion 120) to the angle adjuster element 130 in such a manner as to prevent the dislocation of the shaft 111 from the angle adjuster element 130. When the thread portion 121 is tightened so that the neck portion 120 is screwed into the internal thread 131, an upper end face (a pressurized surface) 120*c* of the neck portion 120 is pressed against by the internal thread 131, whereby the neck portion 120 is prevented from being dislocated from the angle adjuster element 130. Namely, by the external thread 121 provided on the neck portion 120 being screwed into the internal thread 131 formed on the inner surface of the large-diameter portion 130*b*, the angle adjuster element 130 and the shaft 111 can be fittingly attached to each other in the detachable fashion.

Note that a washer (a rubber O ring, a washer and the like) is preferably interposed between a head portion 121*a* of the external thread 121 and the internal thread 131.

The neck portion 120 of the shaft 111 and the angle adjuster element 130 are fittingly attached to each other in such a state that rotation therebetween is prevented by the rotation preventive mechanism 125 which will be described below. The rotation preventive mechanism 125 of this embodiment is made up of a cutout portion 120*h* which is formed on an outer surface of a lower part of the neck portion 120 and a projecting portion 130*h* which is formed on an inner surface of the fittingly attaching hole 130*c* and which has a shape matching that of the cutout portion 120*h*.

The projecting portion 130*h* and the cutout portion 120*h* may only have to have a shape which can prevent rotation relative to each other and can be configured the same as those of the rotation preventive mechanism 135 provided between the hosel portion 115 and the angle adjuster element 130.

By this configuration, the shaft 111 and the angle adjuster element 130 can be detachably attached to each other by the screw fitted relationship between the external thread 121 and the internal thread 131 and the rotation therebetween is prevented by the rotation preventive mechanism 125. In this case, as has been described above, a play and looseness preventive mechanism may be provided in this portion where the shaft 111 and the angle adjuster element 130 are so attached to each other. Namely, the play and looseness preventive mechanism described above is preferably provided on at least one (or preferably both) of the rotation preventive mechanisms 125, 135.

In addition, in the golf club that is configured as has been described heretofore, a direction specifying mechanism 160 is preferably provided so that the attaching direction of the shaft 111 to the clubhead 112 can be specified in one direction. The direction specifying mechanism 160 can be made by specifying, for example, positions where to form the cutout portion 120*h* and the cutout portion 130*h* on the rotation preventive mechanism 125 which is installed between the shaft portion 111 and the neck portion 120 and/or the rotation preventive mechanism 135 which is installed between the hosel portion 115 and the angle adjuster element 130.

Namely, in a construction in which the clubhead 112 and the angle adjuster element 130 can be assembled together independently of the shaft 111, in the event that the direction specifying mechanism 160 is provided between the angle adjuster element 130 and the shaft 111, the shaft 111 can be assembled to the angle adjuster element 130 in such a manner that the direction of the shaft 111 (the direction of the back seam on the grip) becomes constant. Of course, in the event that the direction specifying mechanism 160 is also provided between the clubhead 112 and the angle adjuster element 130, when attaching the shaft 111 to which the angle adjuster element 130 is fixed to the clubhead 112, the clubhead 112 can be assembled to the angle adjuster element 130 in such a manner that the direction of the shaft 111 (the direction of the back seam on the grip) becomes constant.

As has been described above, the angle adjuster element 130 is interposed between the shaft 111 and the hosel portion 115 of the clubhead 112 and has the function to adjust the angle defined between the axis X2 of the shaft 111 and the axis X of the hosel portion 115. In this case, by the angle (the adjustment angle) between the shaft 111 and the hosel portion 115 being changed, in other words, by removing the angle adjuster element disposed between the shaft 111 and the clubhead 112 and interposing another angle adjuster element between the shaft 111 and the clubhead 112, the loft angle and the face angle or the lie angle can be changed without changing the shaft 111 and the clubhead 112. Namely, only by removing the angle adjuster element 130 from the clubhead 112 or the shaft 111 to be simply replaced with another angle adjuster element, the loft angle, the face angle and the lie angle can be changed to a desired condition, and therefore, by preparing a number of such angle adjuster elements, the golf club can be obtained in which the loft angle and the lie angle can be changed to a desired angle in an easy and simple fashion.

Because of this, for example, when carrying out test striking at points of sale, a large number of golf clubs (a large number of shafts and clubheads) does not have to be prepared, and therefore, the golf club having different loft angles, lie angles and face angles can be prepared with fewer parts. In addition, since even such a change can be implemented only by changing angle adjuster elements which are small parts, an increase in convenience can be realized.

In addition, in the configuration that has been described heretofore, since the hosel portion 115 of the clubhead 112 and the angle adjuster element 130 and the neck portion 120 of the shaft 111 and the angle adjuster element 130 can be detachably attached to each other (can be disassembled) and the rotation therebetween is prevented by the rotation preventive mechanisms 135, 125, the occurrence of looseness or rattling can be prevented, thereby making it possible to realize an ensured fitting attachment. In addition, since the hosel portion 115 and the neck portion 120 are prevented from being dislocated from each other by the dislocation preventive mechanism 150 with the angle adjuster element 130 interposed therebetween, the clubhead attached to the shaft 111 can be replaced with a different clubhead with an arbitrary angle adjuster element 130 fittingly attached to the shaft 111, whereby a wide range of utilizations can be made available, and the clubhead replacement work can be facilitated.

In addition, since the direction specifying mechanism 160 is provided which can specify the attaching direction of the shaft 111 to the clubhead 112 in one direction, although a person who carries out replacement work is not aware of the attaching direction of the neck portion 120 of the shaft 111 to the angle adjuster element 130 which is fittingly attached to the hosel portion 115 of the clubhead 112, the attaching direction of the shaft 111 is determined by the person simply carrying out fittingly attaching work, and hence, the person can carry out the replacement work in a smooth fashion. Consequently, since there is caused no situation in which the circumferential orientation of the grip changes, a grip with a back seam can be used. In addition, since the circumferential orientation of the shaft does not change, the hardness of the shaft in a specific direction (for example, a face surface direction) can also be made constant (in general, a difference in rigidity in the circumferential direction tends to occur easily with shafts which are manufactured by winding a prepreg sheet on a wire). In addition, an erroneous assemblage can be prevented in an ensured fashion, and therefore, the shaft constituent members can be set in a desired state with no error.

In addition, in the golf club having the configuration that has been described heretofore, since the shaft 111, the clubhead 112 and the angle adjuster element 130 can be separated from one another, for example, the following configuration can be realized.

Figure 22:
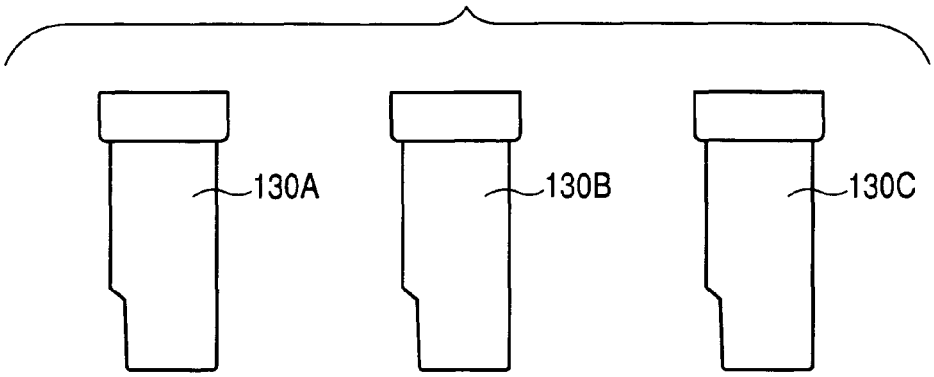
FIG. 22 is a drawing showing one example of a set of angle adjuster elements.

As is shown in FIG. 22, by preparing a plurality of angle adjuster elements which include a reference adjuster element 130A with which the axial center X2 of the shaft 111 coincides with the center axis X of the hosel portion 115 (0 degree) and angled adjuster elements 130B, 130C, . . . which provide a predetermined angle θ as a angle defined between the center axis X of the hosel portion 115 and the axial center X2 of the shaft 111 (for example, angled adjuster elements which can change the loft angle in 1 degree increments as in 1 degree, 2 degrees, . . . ), when the golf player uses a product with the angled adjuster elements 130B, 130C, . . . which are fittingly attached thereto in an interchangeable fashion, the golf player can compare each product state with a reference product state which is provided by the product with the reference adjuster element 130A. As a result of this, when selecting a golf club fitted to the golf player, a more accurate comparison or determination is available, whereby the golf player's satisfaction can be increased.

Figure 23:
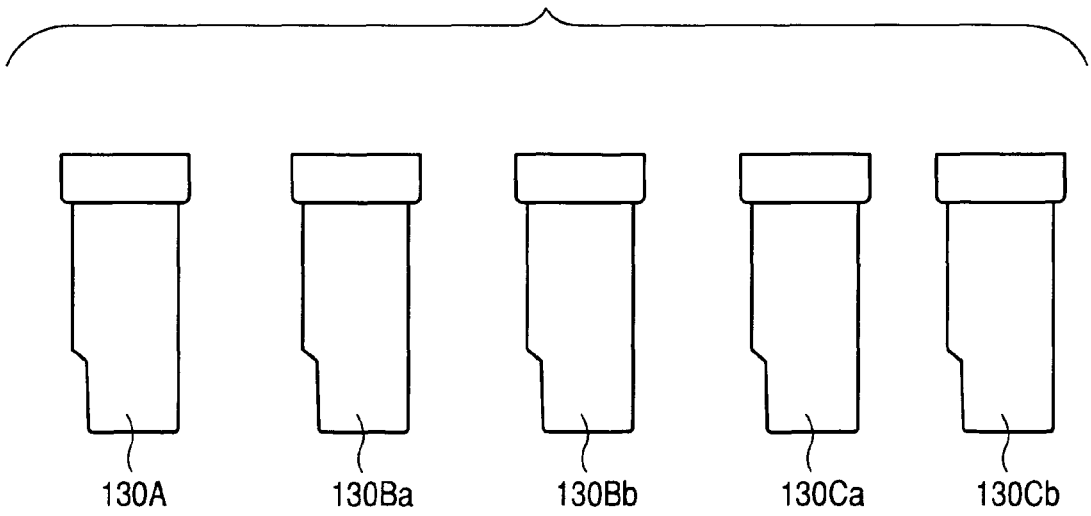
FIG. 23 is a drawing showing another example of a set of angle adjuster elements.

Alternatively, for example, as is shown in FIG. 23, by a plurality of prepared angle adjuster elements being classified into the reference adjuster element 130A and angled adjuster elements which provide a predetermined angle θ as the angle defined between the center axis X of the hosel portion 115 and the axial center X2 of the shaft 111 (130Ba, 130Bb), (130Ca, 130Cb), . . . (example: an angled adjuster element for changing the shaft's position into an upright direction by changing the loft angle by 1 degree (130Ba) and an angled adjuster element for changing the shaft's position into a flat or horizontal direction by changing the loft angle by 1 degree (130Bb), and an angled adjuster element for changing the shaft's position into an upright direction by changing the loft angle by 2 degree (130Ca) and an angled adjuster element for changing the shaft's position into a flat or horizontal direction by changing the loft angle by 2 degree (130Cb), the configuration and combination of the angled adjuster elements can be modified as required.

In addition, while the golf club described above is configured in such a manner that the shaft 111 and the clubhead 112 are provided one for each and the angle adjuster element 130 is made to be replaced with the other angle adjuster elements, in addition to this configuration, a configuration may be adopted in which the golf club has a plurality of shafts which are different in at least one or more performances of basic performances of shaft such as hardness, weight and length. In this case, these shafts which are different in basic performance may be made to be detachably attached to one or more angle adjuster elements. Alternatively, a configuration may be adopted in which angle adjuster elements which are identical or different in configuration are attached, respectively, to the plurality of shafts so prepared, so that the shafts are fitting attached to the hosel portion 115 of the clubhead 112 in an interchangeable fashion.

According to the configurations described above, the shafts having the different performances can be detachably attached to the clubhead of the same construction, and the shafts with various specifications can be used in accordance with the preference of the golf player. As this occurs, it is, of course, possible to change the loft angle and the lie angle by changing the angle adjuster elements in association with the change of the shafts.

In addition, as has been described above, in the configuration in which the plurality of shafts are prepared, at least one of the plurality of angle adjuster elements may be secured to the distal end portion of any of the shafts.

In these configurations, the golf player's way of using the shafts can be made to match his or her desire as in preparing the shaft having conditions which increase the frequency of use, whereby the golf player's satisfaction can be increased.

Further, in addition to the shaft 111, a configuration may be adopted in which the golf club has a plurality of clubheads which are different in at least one or more performances of basic performances of clubhead such as hardness, size, weight and position of center of gravity. In this case, these clubheads which are different in basic performance may be made to be detachably attached to one or more angle adjuster elements. Alternatively, a configuration may be adopted in which angle adjuster elements which are identical or different in configuration are attached, respectively, to the plurality of clubheads so prepared, so that the clubheads are fitting attached to the neck portion 120 of the shaft 111 in an interchangeable fashion.

According to the configurations described above, the clubheads having the different performances can be detachably attached to the shaft of the same construction, and the clubheads with various specifications can be used in accordance with the preference of the golf player. As this occurs, it is, of course, possible to change the loft angle and the lie angle by changing the angle adjuster elements in association with the change of the clubheads.

In addition, in these configurations, too, at least one of the plurality of angle adjuster elements may be secured to any of the clubheads.

In these configurations, the golf player's way of using the clubheads can be made to match his or her desire as in preparing the clubhead having conditions which increase the frequency of use, whereby the golf player's satisfaction can be increased.

Tenth Embodiment

Figure 24:
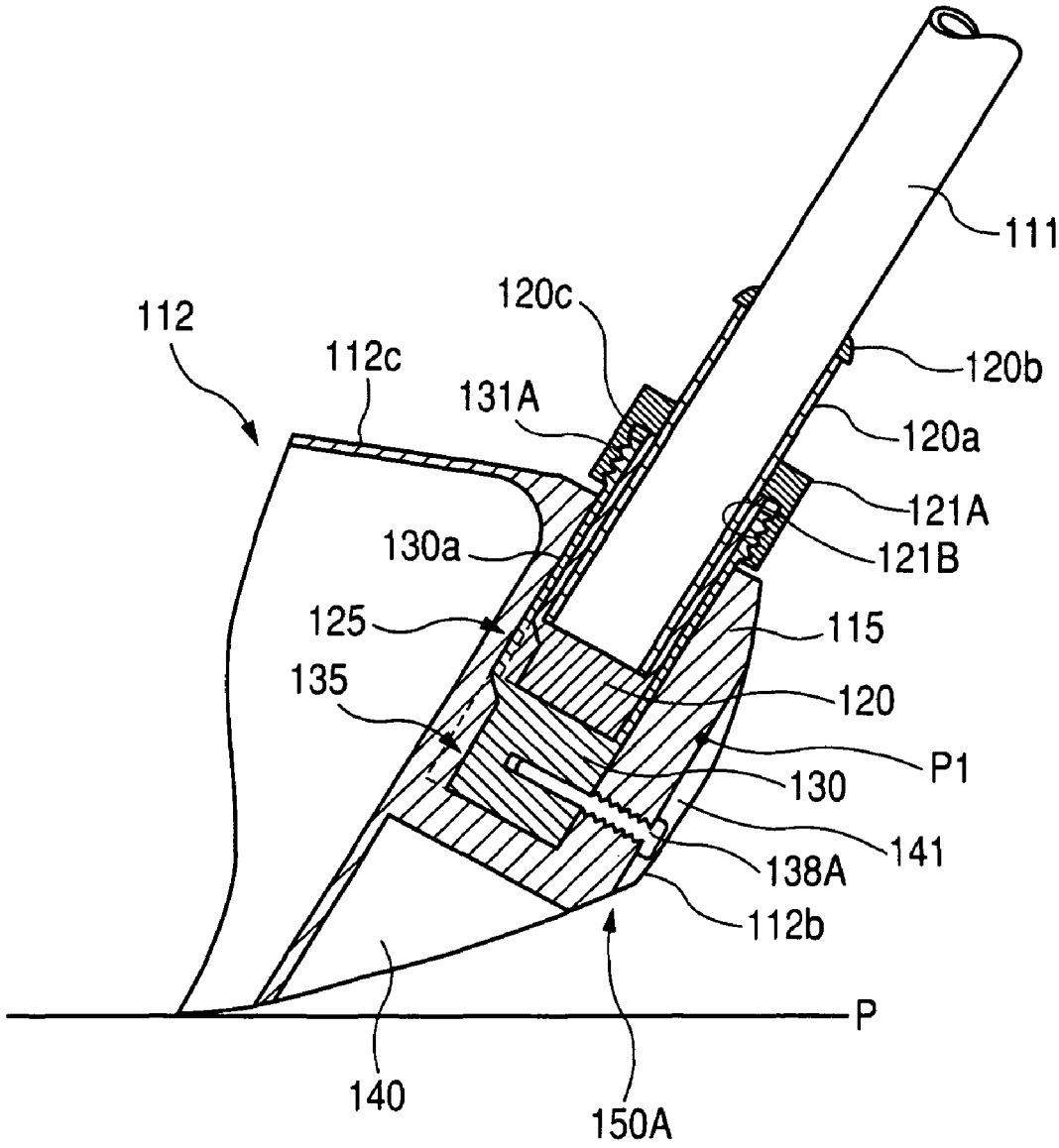
FIG. 24 is a drawing showing a tenth embodiment of a golf club according to the invention.

FIG. 24 is a drawing showing a tenth embodiment of a golf club according to the invention.

In this embodiment, a dislocation preventive mechanism 150A is installed at the heel portion 112*b* side which functions to prevent the occurrence of dislocation between a hosel portion 115 and a neck portion 120 in such a state that an angle adjuster element 130 is interposed therebetween.

In this dislocation preventive mechanism 150A, a recessed portion is formed in a heel portion 112*b* in advance, and by screwing a screw 138A into the hosel portion 115 and the angle adjuster element 130 from the heel portion side, the occurrence of dislocation between the hosel portion 115 and the neck portion 120 is prevented.

In addition, the screw 138A may be screwed into the respective members on an upper side (a position denoted by P1 in the figure) of the heel portion, so as to fix the hosel portion 115 and the neck portion 120 together. When the screw 138A is located in this position, since the hosel portion 115, the angle adjuster element 130 and the neck portion 120 can be fixed together at the same time, a thread member 121A and an internal thread portion 131A which are used to fix the neck portion 120 and the angle adjuster element 130 together can be made unnecessary, whereby a reduction in weight of the whole golf club can be realized, and the degree of freedom in design is increased. Further, the angle adjusting time can be shortened. In this way, the position where the dislocation preventive mechanism is installed can be modified as required.

In addition, in the event that the dislocation preventive mechanism 150A is installed in the position described above, a configuration may be adopted in which a recessed portion 140 which is formed at a sole portion side is not formed or the portion where the recessed portion 140 is to be formed may be made hollow.

In addition, in this embodiment, the thread member 121A for detachably attaching the shaft 111 (the neck portion 120) to the angle adjuster element 130 is formed into a cup shape, so that an internal thread portion 121B is formed on an inside of the cup-shaped thread member 121A, and this internal thread portion 121B is screwed on an external thread portion 131A formed on an upper side of a cylindrical portion 130*a* of the angle adjuster element 130. In addition, by a back surface of the cub-shaped thread member 121A being pressed against an upper end surface (a pressurized surface) 120*c* of the neck portion 120, the neck portion 120 is fixed to the angle adjuster element 130 while the dislocation thereof from the angle adjuster 130 is being prevented.

In this way, the construction can be modified as required in which the neck portion 120 is detachably attached to the angle adjuster element.

Thus, while the embodiments of the invention have been described heretofore, the invention is not limited to the embodiments described but can be modified variously.

For example, the rotation preventive mechanisms 125, 135 can be modified as required with respect to their installing locations and specific constructions. In addition, the construction of the angle adjuster element 130 and the examples of sets or combinations thereof described above are so described only for the purpose of illustrating the examples thereof, and therefore, they can take various forms. For example, a construction may be adopted in which the fitting attaching hole 130*c* of the angle adjuster element 130 into which the shaft 111 is fitted and the axis X2 of the shaft are inclined in advance, and the lie angle and the loft angle can be changed by allowing the selection of the position of the shaft to be so fitted in the hole in question in the rotational direction.

Further, while the play and looseness preventive mechanism is installed by making use of the portion where the rotation preventive mechanisms 125, 135 are provided, the play and looseness preventive mechanism may be installed in other portions.

What is claimed is:

1. A golf club, comprising:

a clubhead including a hosel portion having a first screw portion and a first support surface;

a shaft including a neck portion having a second screw portion which screws into the first screw portion and a second support surface opposed to the first support surface; and an adjuster element for selecting an attaching position in a rotating direction of the shaft to the clubhead, said adjuster element being interposed between the first and second support surfaces when the clubhead is fixed to the shaft by the first and second screw portions being screwed together, wherein a center axis of an inserting area on the first or second screw portion, where an internal thread is formed, is inclined at a predetermined angle with respect to a center axis of the shaft which results when the clubhead is fixed to the shaft, and wherein the adjuster element includes a plurality of adjuster elements which have different thicknesses, so that the attaching position in the rotating direction of the shaft to the clubhead is selected by changing the adjuster elements.

2. The golf club according to claim 1, wherein the plurality of adjuster elements includes a reference adjuster element for setting a reference position in the rotating direction of the shaft relative to the clubhead and a plurality of angle adjuster elements for increasing or decreasing proportionally an angle of the shaft relative to the clubhead from the reference position in a predetermined ratio.

3. The golf club according to claim 1, wherein the adjuster element includes at least one adjuster element having a thickness larger than a screw thread pitch of the screw portion.

4. The golf club according to claim 1, wherein one of the hosel portion and the neck portion forms an insertion hole and the other of the hosel portion and the neck portion forms an insertion portion inserted into the insertion hole.

5. The golf club according to claim 4, wherein an insertion length of the insertion portion into the insertion hole in a state that the screw fitting of the first and second screw portions is released is set to be larger than a diameter of an opening of the insertion hole.

6. The golf club according to claim 4, wherein an outside diameter of a portion of the insertion portion where the adjuster element lies which is interposed between the first and second support surfaces when the clubhead is fixed to the shaft is formed larger than outside diameters of other portions of the insertion portion.

7. The golf club according to claim 4, wherein a vibration absorbing member which is softer than the hosel portion and the neck portion is interposed between the insertion hole and the insertion portion, respectively.

8. The golf club according to claim 1, wherein an engagement portion with which a tool used when attaching or detaching the shaft to or from the clubhead is brought into engagement is formed on the neck portion.

9. The golf club according to claim 1, wherein a space portion is formed in the hosel portion or the neck portion, so that a weight adjuster member is held in the space portion in a replaceable fashion.

10. The golf club according to claim 1, wherein the shaft has a grip attached to an end of the shaft which is opposite to an end to which the clubhead is attached, and an external shape of at least an area of the grip which is gripped is formed into a circular shape in cross section.

11. The golf club according to claim 1, wherein the adjuster element abuts on an uppermost surface of the hosel portion.

12. The golf club according to claim 1, wherein a space that extends from the first support surface to the second support surface is filled with the adjuster element.

13. A golf club, comprising;

a clubhead including a hosel portion;

a shaft including a neck portion fittingly attached to the hosel portion; and an angle adjuster element for selecting an attaching position in a rotating direction of the shaft to the clubhead, said angle adjuster element being interposed between the hosel portion and the neck portion to adjust an axial center of the shaft to a predetermined angle with respect to a center axis of the hosel portion, the angle adjuster element being replaceable for the hosel portion and the neck portion, wherein the angle adjuster element comprises a plurality of angle adjuster elements which have different thicknesses such that the attaching position in the rotating direction of the shaft to the clubhead is selected by changing the angle adjuster elements.

14. The golf club according to claim 13, wherein said angle adjuster elements comprise at least a reference adjuster element for setting a reference position in the rotating direction of the shaft relative to the clubhead, and an angled angle adjuster element for causing the shaft and the hosel portion to form a predetermined angle between the axial center of the shaft and the center axis of the hosel portion.

15. A golf club attaching and detaching system comprising:

the golf club according to claim 14, wherein a plurality of shafts which are different in at least one or more performances of shaft performances such as hardness, weight and length of shaft are provided, and wherein at least one of the plurality of angle adjuster elements is secured to a distal end portion of any of the shafts.

16. A golf club attaching and detaching system comprising:

the golf club according to claim 13, wherein a plurality of the shafts which are different in at least one or more performances of shaft performances such as hardness, weight and length of shaft are provided, and wherein each shaft is made to be detachably attached to the angle adjuster element or the hosel portion of the clubhead.

17. A golf club attaching and detaching system comprising:

the golf club according to claim 13, wherein a plurality of clubheads which are different in at least one or more performances of clubhead performances such as size, weight and position of center of gravity of clubhead are provided, and wherein each clubhead is made to be detachably attached to the angle adjuster element or the neck portion of the shaft.

18. The golf club according to claim 13, wherein the angle adjuster element abuts on an uppermost surface of the hosel portion such that a space that extends from the uppermost surface of the hosel portion to a support surface of the shaft is filled with the angle adjuster element.

19. A golf club, comprising:

a clubhead including a hosel portion having a first screw portion and a first support surface;

a shaft including a neck portion having a second screw portion which screws into the first screw portion and a second support surface opposed to the first support surface; and an adjuster element interposed between the first and second support surfaces when the clubhead is fixed to the shaft by the first and second screw portions being screwed together, wherein a center axis of an inserting area on the first or second screw portion, where an internal thread is formed, is inclined at a predetermined angle with respect to a center axis of the shaft which results when the clubhead is fixed to the shaft, and wherein the adjuster element includes a plurality of adjuster elements which have different thicknesses, such that an attaching position in a rotating direction of the shaft to the clubhead is selected by changing the adjuster elements.

* * * * *